US005372078A

United States Patent [19]

Hoshina et al.

[11] Patent Number: 5,372,078

[45] Date of Patent: Dec. 13, 1994

[54] AUTOMATIC SEWING MACHINE HAVING A DRIVING MECHANISM FOR DRIVING A CLOTH PRESSER UNIT ACCORDING TO A SEWING PATTERN

[75] Inventors: Nozomi Hoshina; Iwao Yamane; Yoshifumi Nishizawa, all of Aichi, Japan

[73] Assignee: Mitsubishi Denki Kabushiki Kaisha, Tokyo, Japan

[21] Appl. No.: 900,588

[22] Filed: Jun. 18, 1992

[30] Foreign Application Priority Data

Jun. 20, 1991 [JP] Japan ..... 3-148676

[51] Int. Cl.[5] ..... D05B 21/00

[52] U.S. Cl. ..... 112/121.12

[58] Field of Search ..... 112/121.12, 121.11, 112/103, 102, 220, 453, 456, 320

[56] References Cited

U.S. PATENT DOCUMENTS

| | | | |
|---|---|---|---|
| 4,309,950 | 1/1982 | Franklin | 112/121.12 |
| 4,391,211 | 7/1983 | Yamamoto et al. | 112/121.12 |
| 4,459,926 | 7/1984 | Ohniwa | 112/121.12 |
| 4,479,446 | 10/1984 | Johnson et al. | 112/121.12 |
| 4,616,583 | 10/1986 | Takano et al. | 112/121.12 |
| 4,633,794 | 1/1987 | Kato | 112/121.11 |
| 4,683,827 | 8/1987 | Kinoshita et al. | 112/121.12 |
| 4,763,586 | 8/1988 | Takenoya et al. | 112/121.12 |
| 5,065,684 | 11/1991 | Hansberry | 112/320 X |

FOREIGN PATENT DOCUMENTS

| | | |
|---|---|---|
| 60-29515 | 7/1985 | Japan . |
| 60-54076 | 11/1985 | Japan . |
| 62-109595 | 5/1987 | Japan . |
| 63-277084 | 11/1988 | Japan . |
| 355903 | 8/1991 | Japan . |

*Primary Examiner*—Peter Nerbun

*Attorney, Agent, or Firm*—Sughrue, Mion, Zinn, Macpeak and Seas

[57] ABSTRACT

An automatic sewing machine control device in which the movement of the presser unit which takes place while the thread take-up lever moves from the bottom dead point to the top dead point is minimized thereby to increase the tension of the upper thread. Even when the load weight applied to a bi-axial drive mechanism increases or the thickness of the sewing material changes, excellent seams can be formed. In a control device for an automatic sewing machine, a start timing unit is provided which starts the bi-axial drive mechanism with respective timing modes. A plurality of drive control data for a drive motor and stepping motors are stored in memory unit which correspond to the load weights applied to the bi-axial drive mechanism and the thicknesses of materials to be sewed.

6 Claims, 21 Drawing Sheets

ROM 7b DATA

| ADDRESS | DATA TABLE | |
|---|---|---|
| (a) | PULSE DATA | 220 |
| (b) | COUNT BORROW DATA | 221 |
| (c) | SPEED LIMIT DATA | 222 |

FIG. 6
| STITCH LENGTH / SPEED | 0.1 | 0.2 | 0.3 | 0.4 | ---------- | 12.5 | 12.6 | 12.7 |
|---|---|---|---|---|---|---|---|---|
| 2000 | 100 | 99 | 98 | 97 | ---------- | 40 | 39 | 38 |
| 1800 | 105 | 104 | 103 | 102 | ---------- | 45 | 46 | 47 |
| 1600 | — | — | — | — | ---------- | — | — | — |
| ⋮ | ⋮ | ⋮ | ⋮ | ⋮ | | ⋮ | ⋮ | ⋮ |
| 400 | 132 | 131 | 130 | 129 | ---------- | 60 | 59 | 58 |
| 200 | 130 | 129 | 128 | 127 | ---------- | 65 | 64 | 63 |
FIG. 7
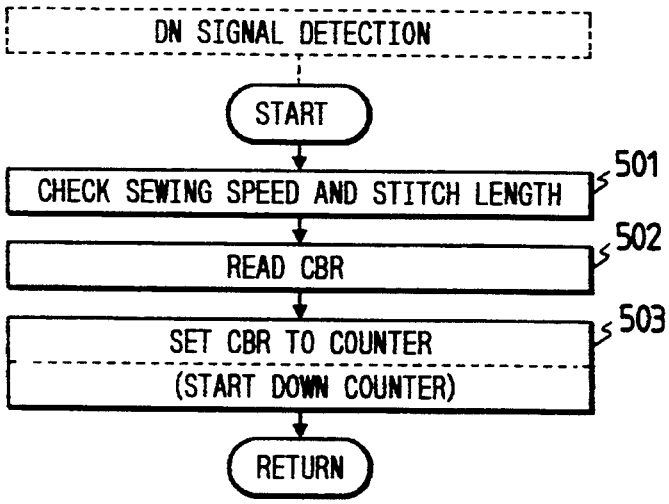
FIG. 8
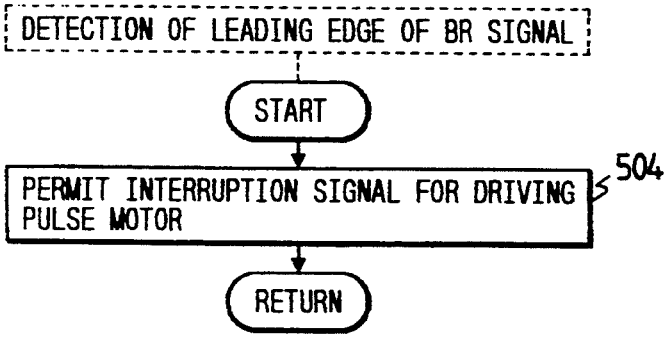

FIG. 18

FEED PULSE DATA

| | | ADDRESS |
|---|---|---|
| SW 15a | ON | (a) |
| | OFF | (b) |

COUNT BORROW DATA

| SW 15b | OFF | ON | OFF | ON |
|---|---|---|---|---|
| SW 15c | OFF | OFF | ON | ON |
| ON | (c) | (d) | (e) | AUTO-SETTING |
| OFF | (f) | (g) | (h) | |

SPEED LIMIT DATA

| SW 15b | OFF | ON | OFF | ON |
|---|---|---|---|---|
| SW 15c | OFF | OFF | ON | ON |
| ON | (i) | (j) | (k) | AUTO-SETTING |
| OFF | (ℓ) | (m) | (n) | |

FIG. 19

COUNT BORROW DATA AND SPEED LIMIT DATA

| CLOTH THICKNESS | | 0 ~ 3.0 | 3.1 ~ 6.0 | 6.1 ~ (mm) |
|---|---|---|---|---|
| SW 15a | ON | (c), (i) | (d), (j) | (e), (k) |
| | OFF | (f), (ℓ) | (g), (m) | (h), (n) |

AUTOMATIC SEWING MACHINE HAVING A DRIVING MECHANISM FOR DRIVING A CLOTH PRESSER UNIT ACCORDING TO A SEWING PATTERN

BACKGROUND OF THE INVENTION

1. Field of the Invention

This invention relates to a control device for an automatic sewing machine in which a drive mechanism drives a presser unit, according to a sewing pattern stored in memory, which holds a material to be sewed (hereinafter referred to as "a sewing material", when applicable) to form a seam.

2. Description of the Related Art

FIG. 1 is a perspective view showing a conventional automatic sewing machine. In FIG. 1, reference numeral 201 designates a sewing machine table; 202, a needle bar; 203, a thread take-up lever; 24, a drive motor; 25, a mechanism section for converting the rotation of the drive motor 24 into the vertical motion of the needle bar 202 or the swing motion of the thread take-up lever 203; 206, a presser unit for pressing a sewing material to hold it; 207, a shuttle race slide; 208, a bi-axial drive mechanism for moving the pressure unit 206 on the shuttle race slide 207 according to a predetermined pattern; 29 and 30, origin detectors for detecting the mechanical origins of two axes provided for the bi-axial drive mechanism 208; and 209, a control unit for controlling the operations of the above-described components.

The control unit 209 is coupled to an operating panel 40 having a power switch 211, a magnetic data writing and reading means (or a floppy disk driver) 47 (hereinafter referred to as "an FDD 47", when applicable) for writing data in and reading data from a floppy disk 48 (hereinafter referred to as "an FD 48", when applicable) to set sewing patterns and sewing speed. The control unit 209 is further coupled to a foot pedal 31 having a start switch 216 for providing a sewing operation start instruction, and a switch 214 for operating the presser unit 206 (hereinafter referred to as "a presser switch 214", when applicable), and to a stop switch 215 for suspending a sewing operation. Provided on the operating panel 40 are a liquid crystal display unit 217 (hereinafter referred to as "an LCD 217", when applicable) for displaying a procedure of sewing operation, current sewing conditions, error messages, etc., a reset switch 212 for setting the bi-axial drive mechanism 208 at a predetermined position to reset the system, a test switch 213 for driving the two axes without rotation of the spindle of the sewing machine; a speed setting switch 218 for the number of revolutions per minute of the drive motor during sewing; and a group of switches 210 for forming, calling or erasing sewing data as required.

FIG. 2 is a block diagram showing the arrangement of the aforementioned control unit 209. In FIG. 2, reference numeral 1 designates a microcomputer, the center of the control circuit; 32, a crystal vibrator for producing a fundamental frequency for operating the microcomputer 1; 2, an address latch circuit for latching addresses in a memory (a RAM 6 or ROM 7); 3, a memory data buffer for transmitting data from the memory (the RAM 6 or ROM 7) to the microcomputer 1 or vice versa; 4, a periphery data buffer for transmitting data from peripheral elements other than the memory (the RAM 6 or ROM 7) to the microcomputer 1 or vice versa; 5, an IC select signal generating circuit for generating IC select signals for selecting the memory (the RAM 6 or ROM 7) and the peripheral elements, respectively; 6, the aforementioned RAM which is a memory element to which access is made to write or read data; 7, the aforementioned ROM which is a memory element to which access is made only to read data; 8, an I/O for controlling a variety of parallel input signals; 9, a motor drive circuit for operating the drive motor 24; 10, 11 and 12, input interface circuits for receiving control signals and applying them to the I/O 8; and 13, a stepping motor driver which receives through the I/O 8 a feed pulse generated by the microcomputer 1, to control stepping motors 27 and 28 which form the bi-axial drive mechanism 208. Further in FIG. 2, reference numeral 14 designates a solenoid drive circuit for driving a thread cutting solenoid 23; 16, a power supply circuit for supplying electric power to the control circuit; 17, 18, 19, 20, 21 and 22, connectors through which signals lines are connected; 26, a detector for providing synchronous signals (for instance a needle lower position signal) in synchronization with the rotation of the sewing machine and a predetermined number of pulses signals per revolution of the sewing machine (hereinafter referred to as "PG signals", when applicable); 45, a feed pulse delay circuit for determining the timing the microcomputer 1 produces the feed pulse (hereinafter referred to as "a count borrow circuit 45", when applicable); and 44, an interruption controller for causing the microcomputer 1 to generate an interruption signal in response to the output signal of the detector 26 received through the input interface circuit 10.

FIG. 3 is a block diagram showing the count borrow circuit 45 and its peripheral circuits. In FIG. 3, the circuit elements which have been described with reference to FIG. 2 are therefore designated by the same reference numerals or characters. Further in FIG. 3, reference numeral 101 designates a down counter which reads data applied thereto through the I/O 8 by the microcomputer 1, and counts the output PG signals of the detector 26 as many as the value set by the data. The down counter 101 outputs a signal when it is set, or when the contents of the counter is zeroed. Further in FIG. 3, reference numeral 102 designates an OR circuit which provides no output signal when the down counter 101 is set; and 103, a flip-flop circuit for latching (self-holding) the signal of the down counter 101.

FIG. 4 is a part of FIG. 2, a circuit for reading data from the ROM 7 or the floppy disk 48 and writing data in the RAM 6 or the floppy disk 48. In FIG. 4, reference numeral 46 designates a floppy disk controller; and 47, the aforementioned floppy disk driver. The ROM 7 has a system region *7a* and a data region *7b* . Programs for operating the microcomputer 1 etc. have been stored in the system region *7a* . On the other hand, stored in the data region *7b* are feed pulse data 220 for the bi-axial drive mechanism 208, start timing data 221 (hereinafter referred to as "count borrow data 221", when applicable), and data 222 for limiting the speed of the sewing machine (hereinafter referred to as "speed limit data 222", when applicable). Those data are provided for the automatic sewing machine only. For instance, count borrow data as shown in FIG. 6 are stored; that is, most suitable count borrow data are stored for stitch lengths in 0.1 mm and numbers of revolutions per minutes, respectively.

The operation of the conventional automatic sewing machine thus organized will be described. The operation of the circuit shown in FIG. 2 has been described in the specifications of Published Unexamined Japanese Patent Application No's 29515/1985 and 54076/1985 in detail. Therefore, mainly the control operation of the bi-axial drive mechanism 208 will be described hereunder.

FIGS. 7, 8 and 9 are flow charts for a description of the control operation of the bi-axial drive mechanism 208 in the conventional automatic sewing machine, and FIG. 26 is a time chart therefor.

In FIG. 26, reference numerals 401, 402, 404, 405, 410 through 416 concern the operations of the conventional automatic sewing machine. More specifically, in FIG. 26, reference numeral 401 designates an needle upper position signal which the detector 26 produces when the needle bar 202 is at the upper position (hereinafter referred to as "an UP signal", when applicable); 402, a needle lower position signal (hereinafter referred to as "a DN signal", when applicable) which the detector 26 produces when the needle bar 202 is at the lower position; 404, the aforementioned PG signal which the detector produces in synchronization with the speed of the sewing machine; 405, a fundamental interruption signal for controlling the stepping motor driver 13 adapted to drive the stepping motors 28 and 27; 410, a borrow signal for controlling the timing of operation of the stepping motors 27 and 28 (hereinafter referred to as "a BR signal 410", when applicable); and 411 and 412, signals representing the drive states of the X-axis and Y-axis stepping motors 27 and 28 (hereinafter referred to as "stepping motor drive signals", when applicable). Further in FIG. 26, reference numerals designate waveforms indicating the loci of movement, in the direction of X-axis and in the direction of Y-axis of the presser unit 206 on the shuttle race slide 207, respectively; 415, a waveform indicating the locus of vertical movement of the thread take-up lever 203; and 416, a waveform indicating the locus of movement of the end of the needle bar 202.

FIG. 7 is a flow chart showing a start inhibit pulse number (or delay pulse number) setting process which is started upon detection of the fall edge 402*a* of the DN signal 401 output by the detector 26 (hereinafter referred to as "a DN signal interruption process", when applicable). FIG. 8 is a flow chart showing a fundamental interruption signal outputting process which is started in response to the production of the BR signal 410. FIG. 9 is a flow chart showing a stepping motor driving process which is started in response to the production of the fundamental interruption signal 405.

When the start switch 216 is turned on, a sewing operation is started according to sewing pattern data and sewing speed which have been programmed in advance. First the sewing machine mechanism section 25 is driven by the drive motor 24, so that the DN signal 402 is output by the detector 26 as shown in FIG. 26. Upon detection of the fall edge 402*a* of the DN signal, the DN signal interruption process shown in FIG. 7 is started. First, in Step 501, the microcomputer 1 stores the sewing speed and stitch length of the next stitch in stack. Then, in Step 502, the delay pulse number CBR which corresponds to the sewing speed and the stitch length is stored in stack. Thereafter, in step 503, the microcomputer 1 sets the delay pulse number CBR in the down counter 101 shown in FIG. 3, and applies a reset signal to the flip-flop circuit 103. The process has been accomplished. When the delay pulse number CBR is set in the down counter 101, the BR signal is set to zero level (410*a*) as shown in FIG. 8. And whenever the detector 26 applies the PG signal 404 to the down counter 101 through the input interface 10, one is reduced from the delay pulse number set therein. When the delay pulse number is reduced to zero, the down counter 101 provides a pulse signal at the BR terminals. as a result of which the output signal, the BR signal 410, of the flip-flop circuit 103 is raised to high level (410*b*).

When the BR signal 410 is raised to high level, the fundamental interruption signal outputting process is started. That is, in Step 504, outputting the fundamental interruption signal 405 for controlling the stepping motor driver 13 is permitted. Thus, the fundamental interruption signal outputting process has been accomplished.

In response to the fundamental interruption signal 405, the stepping motor driving process is started. That is, whenever the rise edge 405*a* of the fundamental interruption signal 405 is detected, the stepping motor driving process is effected. First, in Step 505, it is determined whether or not the X-axis stepping motor 27 has moved a distance corresponding to one stitch length. When it is determined that the motor has moved so, Step 507 is effected; and if not, Step 506 is effected. In Step 506, a sub-routine for driving the X-axis stepping motor 27 is executed. For simplification in description, the driving of the stepping motors will not be described. Next, in Step 507, it is determined whether or not the movement of the Y-axis stepping motor 28 has been accomplished. When it is determined that the movement of the motor 28 has been accomplished, Step 509 is effected; and if not, Step 508 is effected; that is, a sub-routine for driving the Y-axis stepping motor is executed. In Step 509, it is determined whether or not the X-axis stepping motor 27 and the Y-axis stepping motor 28 have moved distances corresponding to one stitch length. When it is determined that the motors have moved so, Step 510 is effected; that is, the outputting of the fundamental interruption signal 405 is inhibited, and the stepping motor driving process is ended. When it is determined that the movement of at least one of the motors 27 and 28 has not been accomplished yet, then stepping motor driving process is ended. Thus, the X-axis stepping motor 27 and the Y-axis stepping motor 28 are started substantially at the same time, and when they are moved distances corresponding to a predetermined stitch length, the driving of them is ended.

In the conventional automatic sewing machine thus organized, the presser unit 206 and the thread take-up lever 203 suffer from the following problems in operation which attribute to the above-described control operation. The problems will be described with reference to FIGS. 26, 27 and 28.

By way of example, let us consider the case where a cloth is sewed obliquely according to a sewing pattern as shown in FIG. 27. In FIG. 27, reference character L designates one stitch length; Lx, the horizontal component, or X-component, of the stitch length L; and Ly, the vertical component, ok Y-component, of the same L. In this case, the loci of movement, in the directions of X-axis and Y-axis, of the presser unit 206 on the shutter race slide 107 are as indicated at 413 and 414 in FIG. 26, respectively.

In general, the timing of starting the presser unit 206 is based on various factors. The first of the factors is that, in order that the motion of the needle bar 202 and the movement of the sewing material may not interfere with each other, the movement of the presser unit 206 must be accomplished before the needle of the needle bar 201 pulled out of the sewing material at the time instant G1 is pushed into the latter again at the time instant G2 as shown in FIG. 26. The loci 413 and 414 of movement, in the directions of X-axis and Y-axis, of the presser unit as shown in FIG. 26 satisfy this requirement.

The second factor resides in the relation between the motion of the thread take-up lever 203 and the movement of the presser unit 206. This will be described with reference to FIG. 28. In FIG. 28, the broken line indicates the amount of movement which is obtained by combining the loci 413 and 414 of movement, in the directions of X-axis and Y-axis, of the presser unit 206 in the conventional automatic sewing machine. Further in FIG. 28, reference character B1 designates the bottom dead point of the thread take-up lever 203, and B2, the bottom dead point of the latter 203. While moving between the two points B1 and B2, the thread take-up lever 203 pulls up the thread, and gives tension to it. If, during this period of time, the presser unit 206 is moved, then the upper thread is supplied excessively, as a result of which the tension of the upper thread is decreased as much. That is, in proportion to the movement of the presser unit 206 which takes place while the thread take-up lever moves between the points B1 and B2, the tension of the upper thread is decreased; that is, so-called "sewing condition" is lowered.

FIG. 10 shows periods of time for which the presser unit 206 is movable in the case where two sewing materials a and b different in thickness are sewed. In FIG. 10, reference characters Ha and Hb designate the thicknesses of the sewing materials a and b, respectively; Ga1, Ga2, Gb1 and Gb2, the intersections of the needle connected to the needle bar 202 and the sewing materials; and La and Lb, presser unit movable periods of time. As is seen from FIG. 10, when the thickness of a sewing material changes, it is necessary to change the timing of starting the presser unit 206.

FIG. 11 shows the locus of movement of the presser unit 206 provided in the case where the load weight of the bi-axial drive mechanism is changed for instance by mounting a predetermined jig on the presser unit 206. In FIG. 11, reference character 413*a* designates a waveform indicating the locus of movement of the presser unit which is under the standard condition; and 413*b*, the locus of movement of the presser unit provided when the jig is mounted on it. When a load is mounted on the bi-axial drive mechanism 208, the latter 208 is greatly vibrated (sic). If, under this condition, the sewing operation is carried out, then the resultant seam is irregular in stitch. Furthermore, if the speed of rotation of the sewing machine is increased, then the stepping motors 27 and 28 cannot follow instructions output by the stepping motor driver 13; that is, so-called "step out" occurs .

With the above-described first and second factors taken account, it can be readily considered that the ideal and practical timing of starting the presser unit 206 is as indicated at 413 and 414*a* in FIG. 26. That is, in the case where the stitch length on the side of X-axis is different from that on the side of Y-axis, by delaying the timing of starting the presser unit on the side of the axis where the stitch length is smaller, the movement of the presser unit 206 which takes place while the thread take-up lever 203 moves to the top dead point B2 can be minimized and the tension of the upper thread can be increased. However, in the conventional automatic sewing machine control device, the driving of the bi-axial drive mechanism 208 is started simultaneously as was described above, and therefore it is impossible to obtain the ideal timing of starting the presser unit.

The count borrow data table 221, the feed pulse data table 220, and the speed limit data table 222 have been stored in the ROM 7*b*, as was described above; however, only one kind of those tables is prepared for one kind of sewing machine. Hence, when the thickness of a sewing material or the load weight of the bi-axial drive mechanism changes, good sewing condition cannot be obtained, or the speed of rotation of the sewing machine cannot be increased.

SUMMARY OF THE INVENTION

Accordingly, an object of this invention is to eliminate the above-described difficulty accompanying a conventional automatic sewing machine control device. More specifically, an object of the invention is to provide an automatic sewing machine having a control device in which the movement of the presser unit which takes place while the thread take-up lever moves from the bottom dead point to the top dead point is minimized to thereby increase the tension of the upper thread, and in which, even when the load weight of the bi-axial drive mechanism increases or the thickness of the sewing material changes, excellent seams can be formed.

The above, and other objects of the present invention are accomplished by the provision of a control device for an automatic sewing machine comprising: a drive motor for driving a spindle of said sewing machine; a presser unit for holding a sewing material to be sewed; a bi-axial drive mechanism capable of driving the presser unit in the directions of two axes separately, which are perpendicular to each other; a drive control means for controlling the drive motor and the bi-axial drive mechanism according to programs and data stored in memory means; and a start timing control means for controlling the bi-axial drive mechanism with respective timing modes.

BRIEF DESCRIPTION OF THE DRAWINGS

In the accompanying drawings:

FIG. 6 is an explanatory diagram for a description of the contents of conventional count borrow data.

FIG. 7 is a flow chart for a description of a conventional DN signal interruption process.

FIG. 8 is a flow chart for a description of a conventional count borrow interruption process.

FIG. 16 is a flow chart for a description of the operations carried out in the control device of the invention until a sewing operation is started after the power switch is turned on.

FIG. 18 is an explanatory diagram indicating the states of change-over switches with data selected thereby in the control device of the invention.

FIG. 19 is an explanatory diagram indicating cloth thicknesses with data selected according to them in an automatic sewing machine control device according to claim 6.

DESCRIPTION OF THE PREFERRED EMBODIMENTS

Preferred embodiments of this invention will be described with reference to the accompanying drawings.

Figure 12:
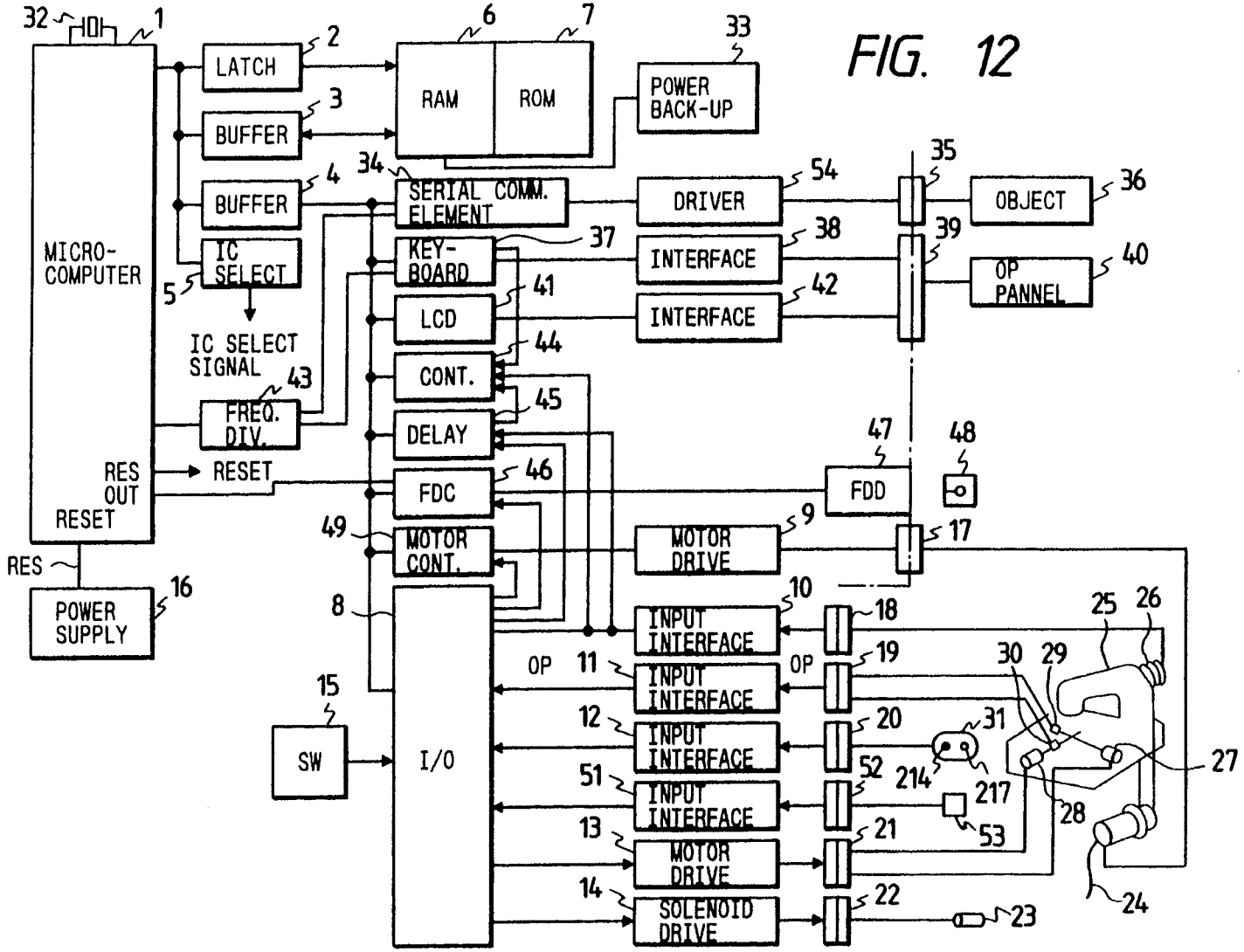
FIG. 12 is a block diagram showing the arrangement of an automatic sewing machine control device which constitutes one embodiment of this invention.

FIG. 12 is a block diagram showing the arrangement of one example of an automatic sewing machine control device according to the invention. In FIG. 12, parts corresponding functionally to those which have been described with reference to the conventional automatic sewing machine control device are therefore designated by the same reference numerals or characters. Further in FIG. 12, reference numeral 15 designates a change-over switch which is operated according to the thickness of a material to be sewed (hereinafter referred to as "a sewing material", when applicable) and the load weight of the bi-axial drive mechanism 208; 33, a power back-up circuit for holding the contents of the RAM 6, which is a volatile memory element, as they are when the power switch is turned off; 34, a serial communication element connected to the peripheral data buffer, for converting parallel data to serial data and vice versa; 54, a driver for allowing the output data of the serial communication element 34 to correspond to a communication standard (such as RS-232C or RS-422) (hereinafter referred to as "a serial communication driver", when applicable); 36, an object which receives an input signal when the serial communication driver 54 is in output state, and which provides an output signal when the serial communication driver 54 is in input state; that is, an object with which a personal computer or the like communicates (hereinafter referred to as "a serial communication object", when applicable); 35, a connector through which the serial communication driver 54 is connected to the serial communication object 36; 37, a key board controller for controlling the reset switch 212, the test switch 213, the speed setting switch 218 and the group of switches 210 on the operating panel 40; 38, an interface circuit provided between those switches and the key board controller 37; and 39, a connector through which the interface circuit 38 is connected to the operating panel 40. Further in FIG. 12, reference numeral 41 designates an LCD controller for driving the LCD 217 in the operating panel 40; 42, an interface circuit provided for output signals from the LCD controller 41 and for input signals from the LCD 217; 43, a frequency division circuit for subjecting a signal of a predetermined frequency which is output by the microcomputer 1 to frequency division, and applying the resultant signal to the serial communication element 34 and the key board controller 37; 49, a motor controller for applying a control signal to the motor drive circuit 9 in response to an instruction from the microcomputer 1; 51, an input interface; 52, a connector; and 53, an abnormal condition detecting circuit for detecting when excessively large current flows in the stepping motor 27 or 28, the drive motor 24, or the thread cutting solenoid 23 or when any one of the signal lines is broken, and informing the microcomputer 1 of it.

Figure 13:
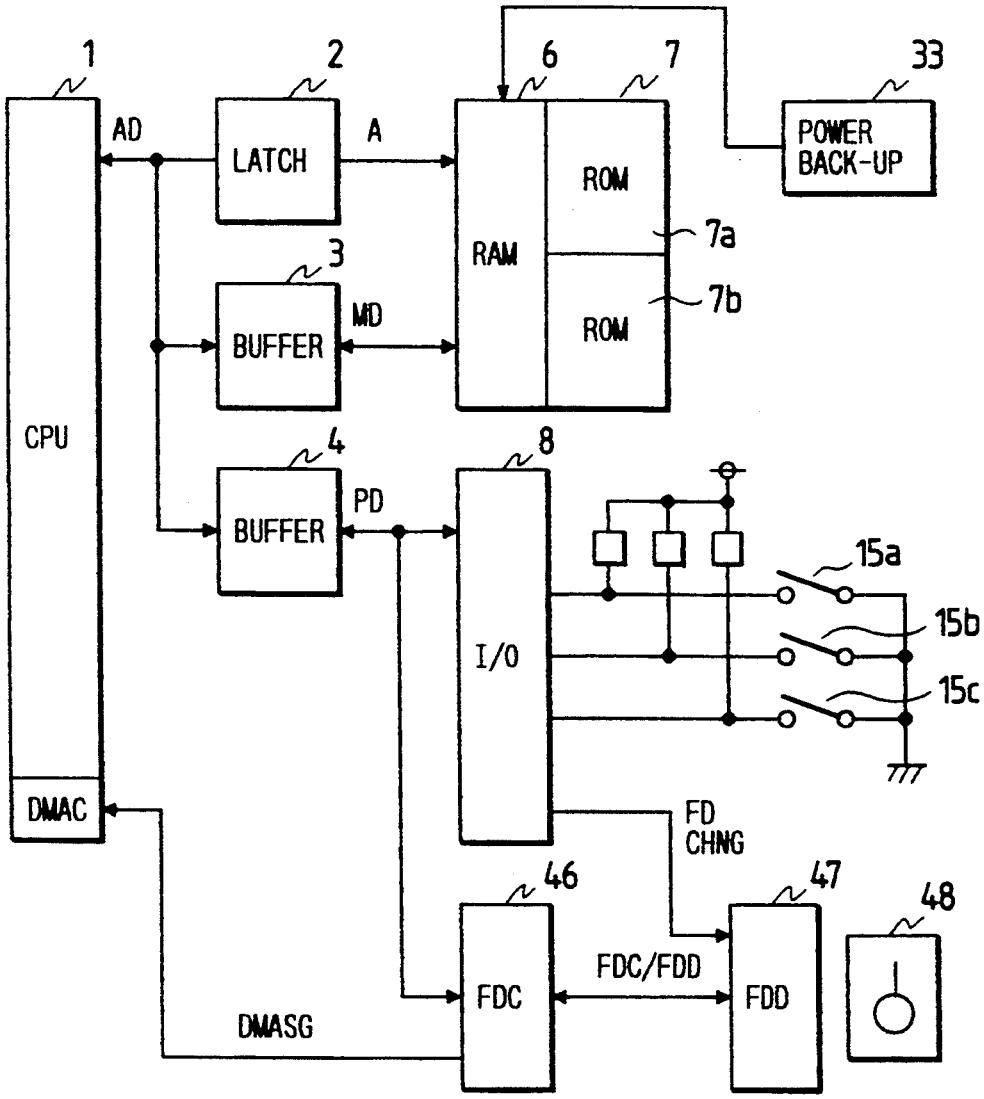
FIG. 13 is a block diagram for a description of data reading and writing operations in the control device of the invention.

FIG. 13 shows a part of the control circuit shown in FIG. 12, namely, a circuit for reading data from the RAM 6, the ROM 7 or the floppy disk 48, or writing data in the RAM 6 or the floppy disk 48. In FIG. 13, those elements which have been described with reference to FIG. 12 are therefore designated by-the same reference numerals or characters. Further in FIG. 13, reference character **15*a* designates a change-over switch which is operated according to the load weight of the bi-axial drive mechanism 208; 15*b* and 15*c***, change-over switches which are operated according to the thickness of a sewing material.

Figure 14:
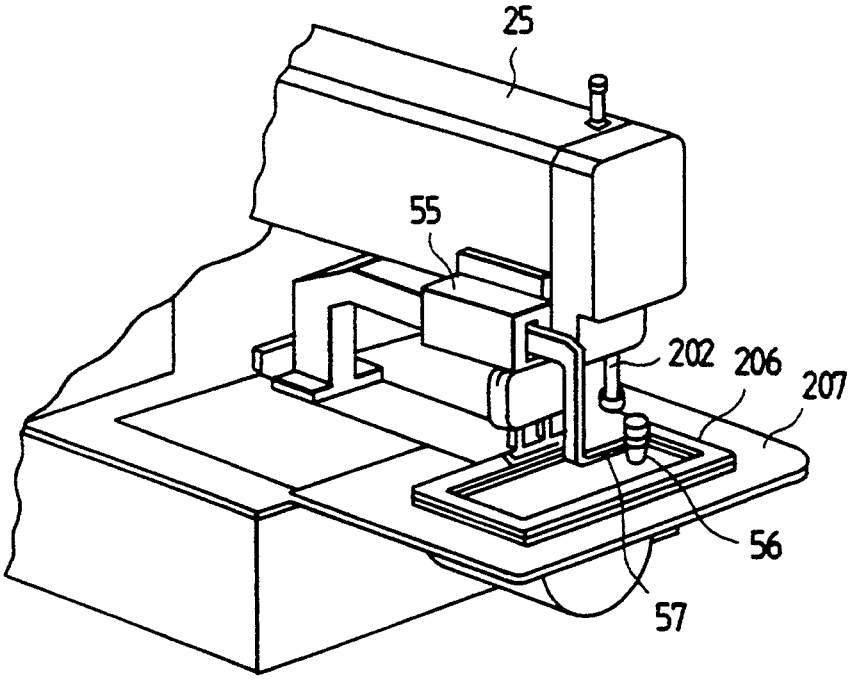
FIG. 14 is a perspective view showing cloth thickness detecting means in the control device of the invention.
Figure 15:
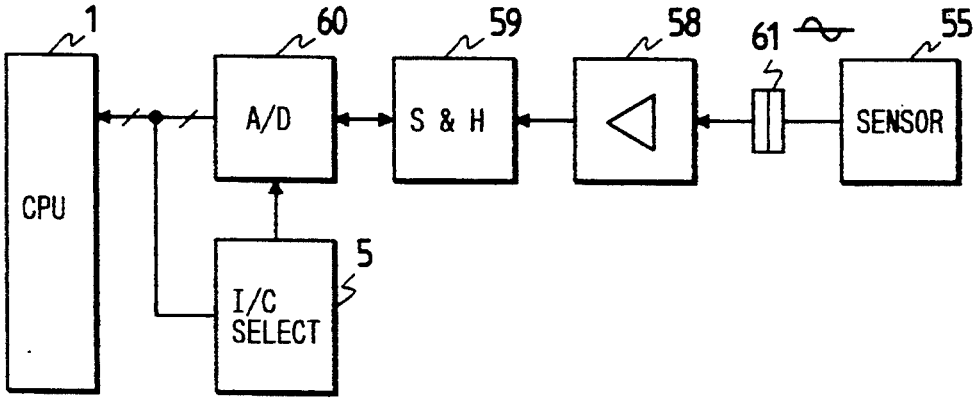
FIG. 15 is a block diagram showing the arrangement of the cloth thickness detecting means in the control device of the invention.

FIGS. 14 and 15 show one example of the automatic sewing machine control device.

FIG. 14 is a perspective view of the automatic sewing machine with cloth thickness detecting means. The cloth thickness detecting means has been disclosed by Published Examined Japanese Patent Application No. 55903/1991. In FIG. 14, reference numeral 55 designates a displacement sensor for converting the displacement of a transmission board 57 into an electrical analog signal; 56, a slider which is provided at the end of the transmission board 57 so as to push a sewing material, and which is slid on the sewing material during the sewing operation; and 55–57, a displacement sensor for transmitting the vertical displacement of the slider 56 to the displacement sensor.

FIG. 15 shows a circuit which converts the analog signal of the displacement sensor 55 into a digital signal which is applied to the microcomputer 1. In FIG. 15, reference numeral 58 designates an operational amplifier for amplifying the voltage of the output analog signal of the displacement sensor 55 to the level which is suitable for analog-to-digital conversion (hereinafter referred to as "A/D conversion", when applicable); 59, a sample and hold circuit for holding an input signal while an A/D conversion circuit 60 is in operation; 60, the aforementioned A/D conversion circuit which converts the output analog signal of the sample and hold circuit 59 into a digital signal; and 61, a connector through which the displacement sensor 55 is connected to the operational amplifier 58.

Figure 1:
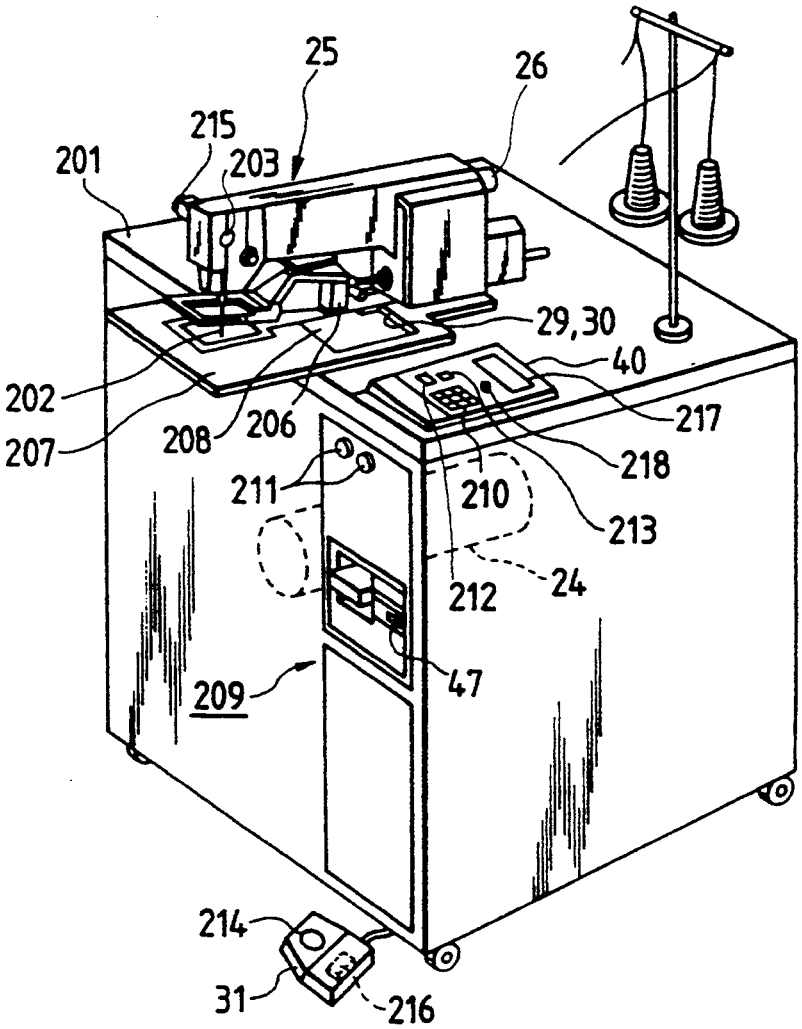
FIG. 1 is a perspective view of a conventional automatic sewing machine.
Figure 2:
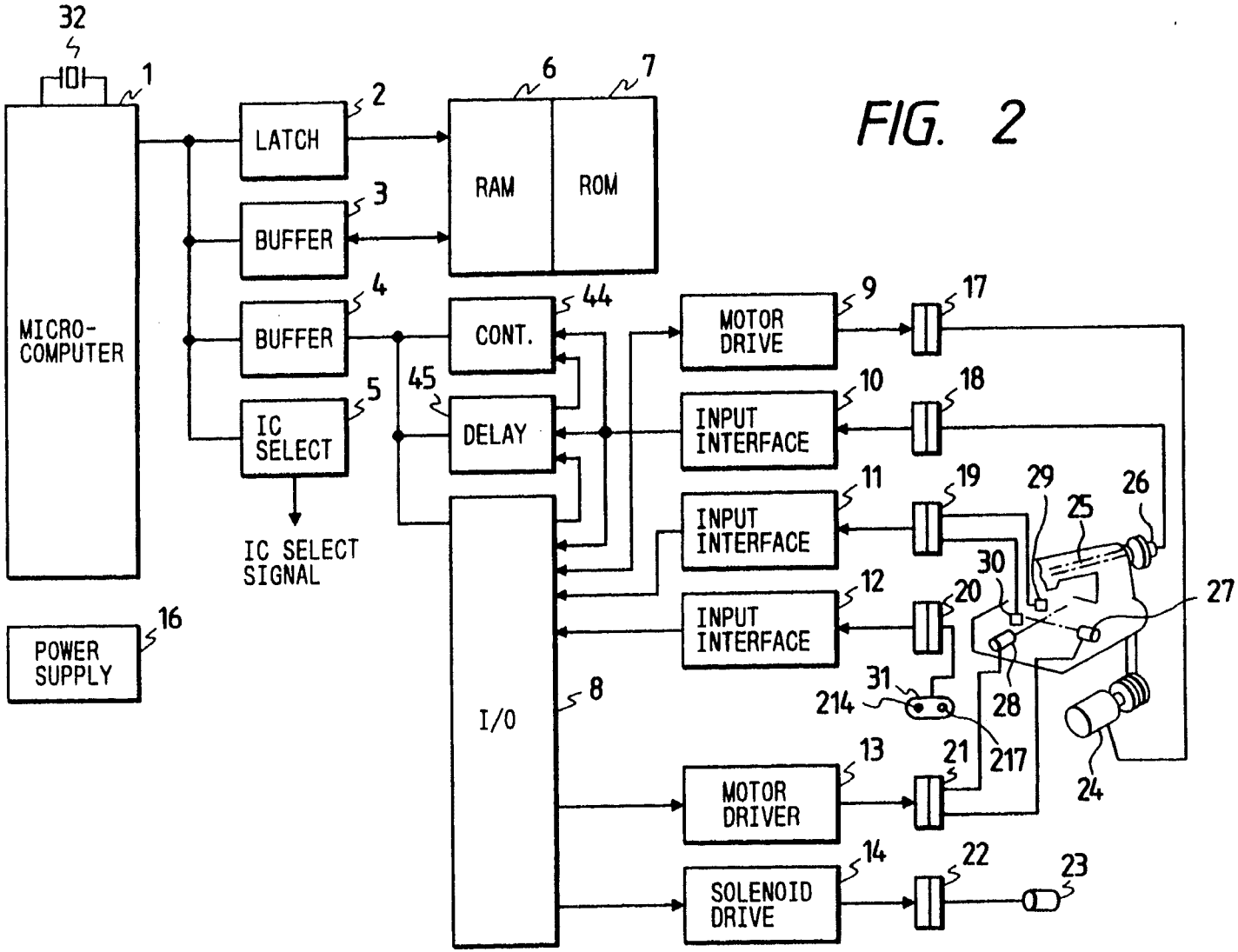
FIG. 2 is a block diagram showing the arrangement of a control device provided for the conventional automatic sewing machine shown in FIG. 19.

Now, the operation of the automatic sewing machine control device thus organized will be described. First, the operations of the control device will be described. A perspective view showing the automatic sewing machine according to the invention in its entirety, and its count borrow circuits are similar to those of the prior art described above. Therefore, FIGS. 2 and 3 will also be referred to for a description of the operations.

Figure 16:
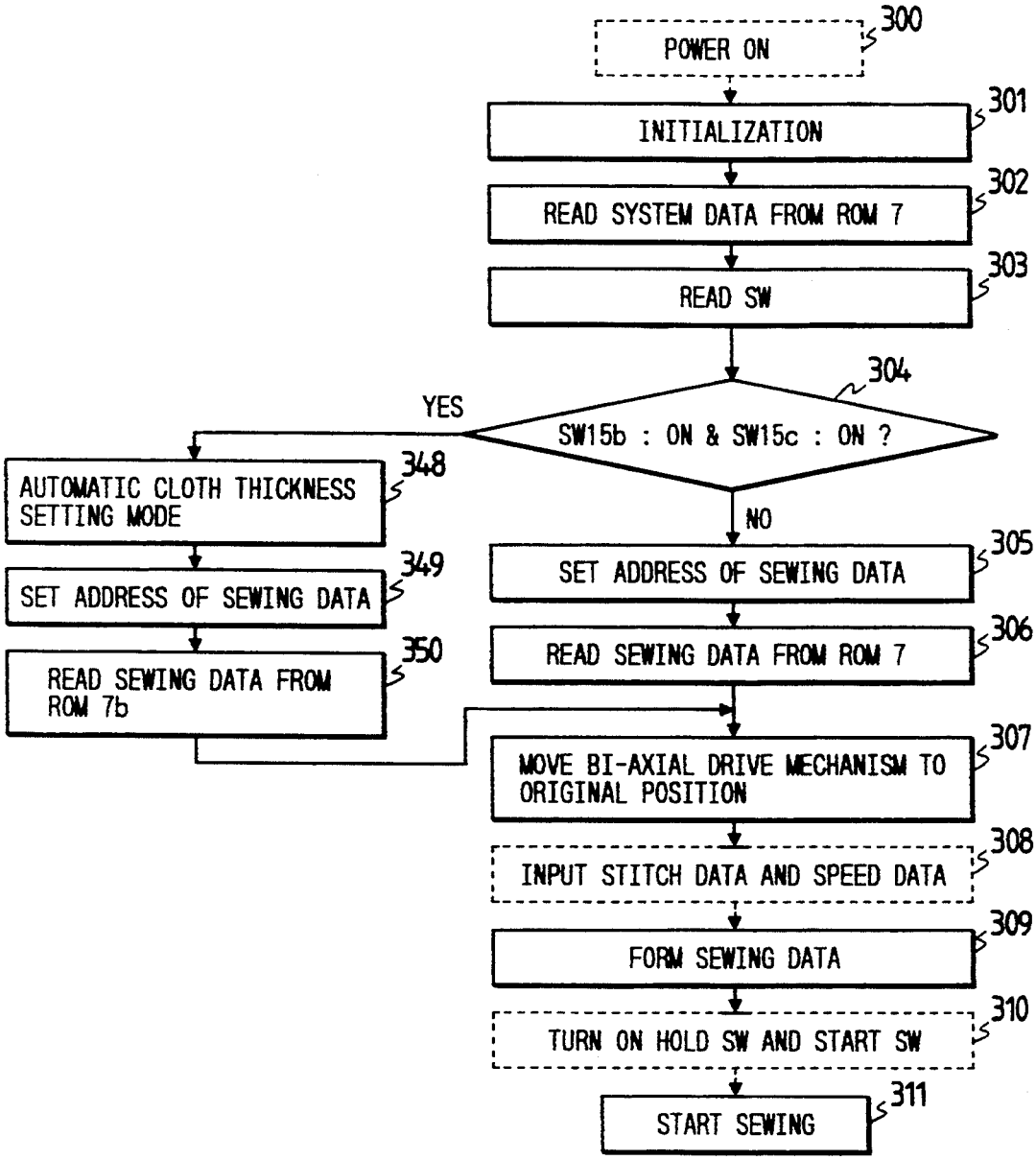

FIG. 16 is a flow chart outlining the operations which are carried out during the period of time which elapses from the time instant that the power switch is turned on until the sewing operation is started. In FIG. 16, the steps encircled by the solid line are carried out by the system, and those encircled by the broken line are carried out by the operator. First, the power switch 211 of the control device 209 is closed (Step 300), to supply electric current to the drive motor 24. When all the elements and circuits in the control device 209 are energized, a reset signal (hereinafter referred to as "a RES signal", when applicable) is applied to the microcomputer 1 to initialize the latter 1, while the microcomputer 1 provides a RES signal at a terminal RESOUT to reset all the elements and circuits (Step 301). After the RES signal is-terminated in a predetermined period of time, the microcomputer 1 operates to read system data from a system region **7*a* in the ROM 7 and store them in memory (Step 302). Next, the "on"0 or "off"0 state of the change-over switch 15 is read (Step 303), and when, in Step 304, both the change-over Switches 15*b* and 15*c* are in "on"0 state, an automatic cloth thickness setting mode is effected. The automatic cloth thickness setting mode will be described later with reference to the operation of the control device. Next, depending on the "on" and "off" states of the change-over switches , the address of necessary data in the data region 7*b* of the ROM 7 is set (Step 305). Under this condition, according to the address thus set, the sewing data operated and stored in advance; that is, the feed pulse data 220, the count borrow data 221 and the speed limit data 222 of the bi-axial drive mechanism 208 are stored in the data region of the RAM 6 (Step 306**).

Figure 17:
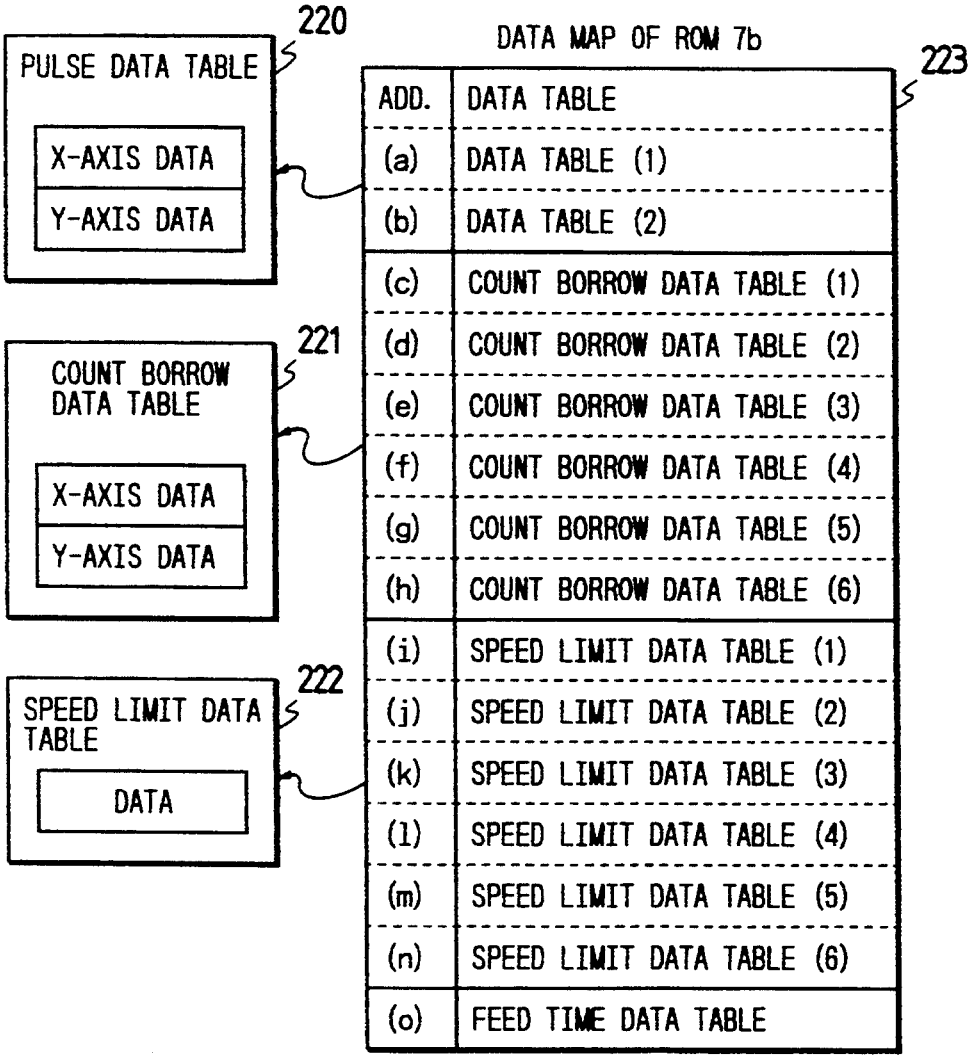
FIG. 17 is an explanatory diagram showing the arrangement of data in a data region in memory means in the control device of the invention.

FIG. 17 shows one example of the arrangement of data in the data region **7*b* of the ROM 7. As shown in FIG. 17, X-axis and Y-axis feed pulse data provided in the case where the load weight of the bi-axial drive mechanism 208 is standard and in the case where it is heavy are stored in addresses (a) and (b), respectively. X-axis and Y-axis count borrow data provided in the three different cases where the sewing materials are small, intermediate and large in thickness with the load weight of the bi-axial drive mechanism being standard, are stored at addresses (c), (d) and (e), respectively. X-axis and Y-axis count borrow data provided in the three different cases where the sewing materials are small, intermediate and large in thickness with the load weight of the bi-axial drive mechanism 208** being heavy, are stored at addresses (f), (g) and (h), respectively. Sewing machine speed limit data are stored at addresses (i) through (n) being classified similarly as in the case of the above-described X-axis and Y-axis count borrow data. Feed time data (described later) is stored at address (o).

FIG. 18 is for a description of one example of a method of utilizing the "on" and "off" states of the change-over switches **15*a*, 15*b* and 15*c* to determined an address from which data is to be read. That is, when the load weight of the bi-axial drive mechanism 208 is standard, the switch 15*a* is turned on; and when it is heavy, the switch 15*a* is turned off. When the sewing material is small in thickness, the switches 15*b* and 15*c* are both turned off;when it is intermediate in thickness, the switch 15*b* is turned on while the switch 15*c* is turned off; and when it is large in thickness, the switch 15*b* is turned off while the switch 15*c* is turned on. For instance in the case where the load weight of the bi-axial drive mechanism is standard, and the sewing material is intermediate in thickness, the feed pulse data at the address (a), the count borrow data at the address (d) and the speed limit data at the address (j) in the ROM 7 are read by turning on the switches 15*a* and 15*b* and by turning off the switch 15*c***.

When the sewing data is stored in the RAM 6, in order to move the bi-axial drive mechanism 208 to the original position the microcomputer 1 applies a signal to the stepping motor driver 13 to drive the stepping motors 27 and 28. Upon reception of the origin signal (OP in FIG. 12) from the origin detectors 29 and 30, the microcomputer 1 operates to stop the stepping motors 27 and 28 (Step 307 in FIG. 17). Thereafter, stitch data and sewing speed are set (Step 308). These data and the above-described sewing data, namely, the feed pulse data 220, count borrow data 221 and speed limit data 222 are combined into most suitable sewing data (Step 309). Thereafter, the hold switch is turned on, and the start switch is turned on (Step 310), to start the sewing operation.

Figure 21:
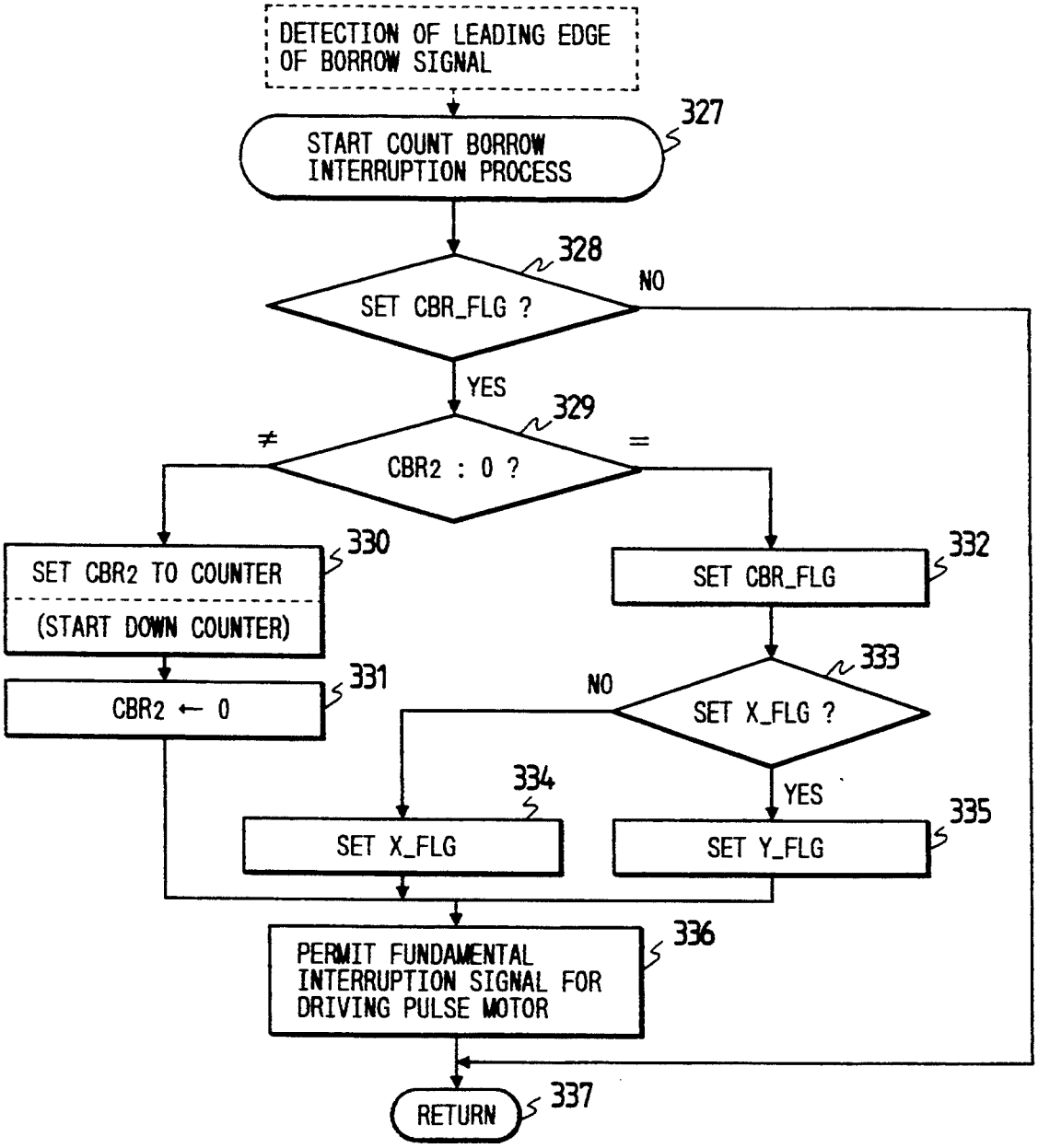
FIG. 21 is a flow chart for a description of a count borrow interruption process in the control device of the invention.
Figure 22:
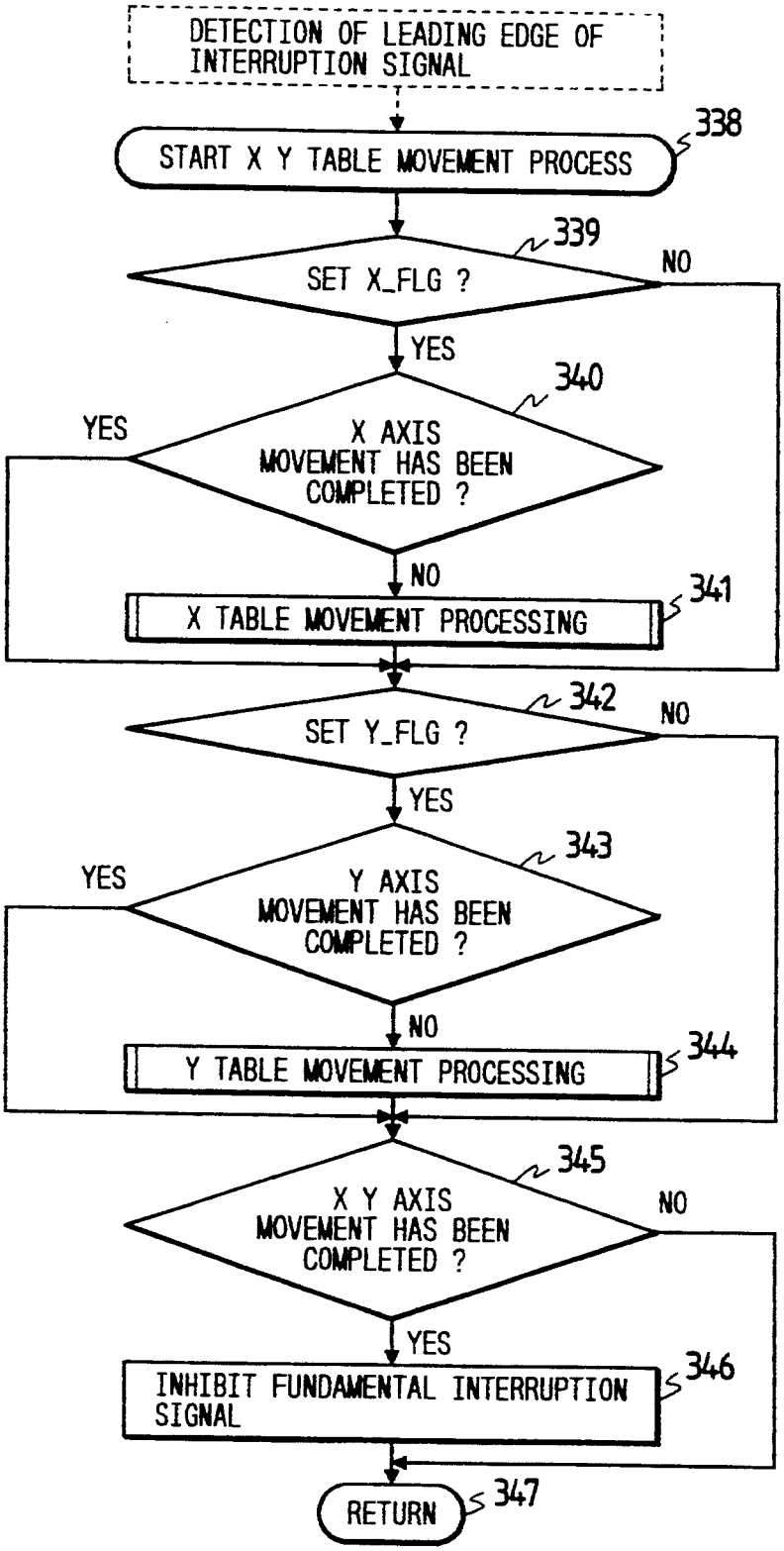
FIG. 22 is a flow chart for a description of an X Y table movement process in the control device of the invention.
Figure 26:
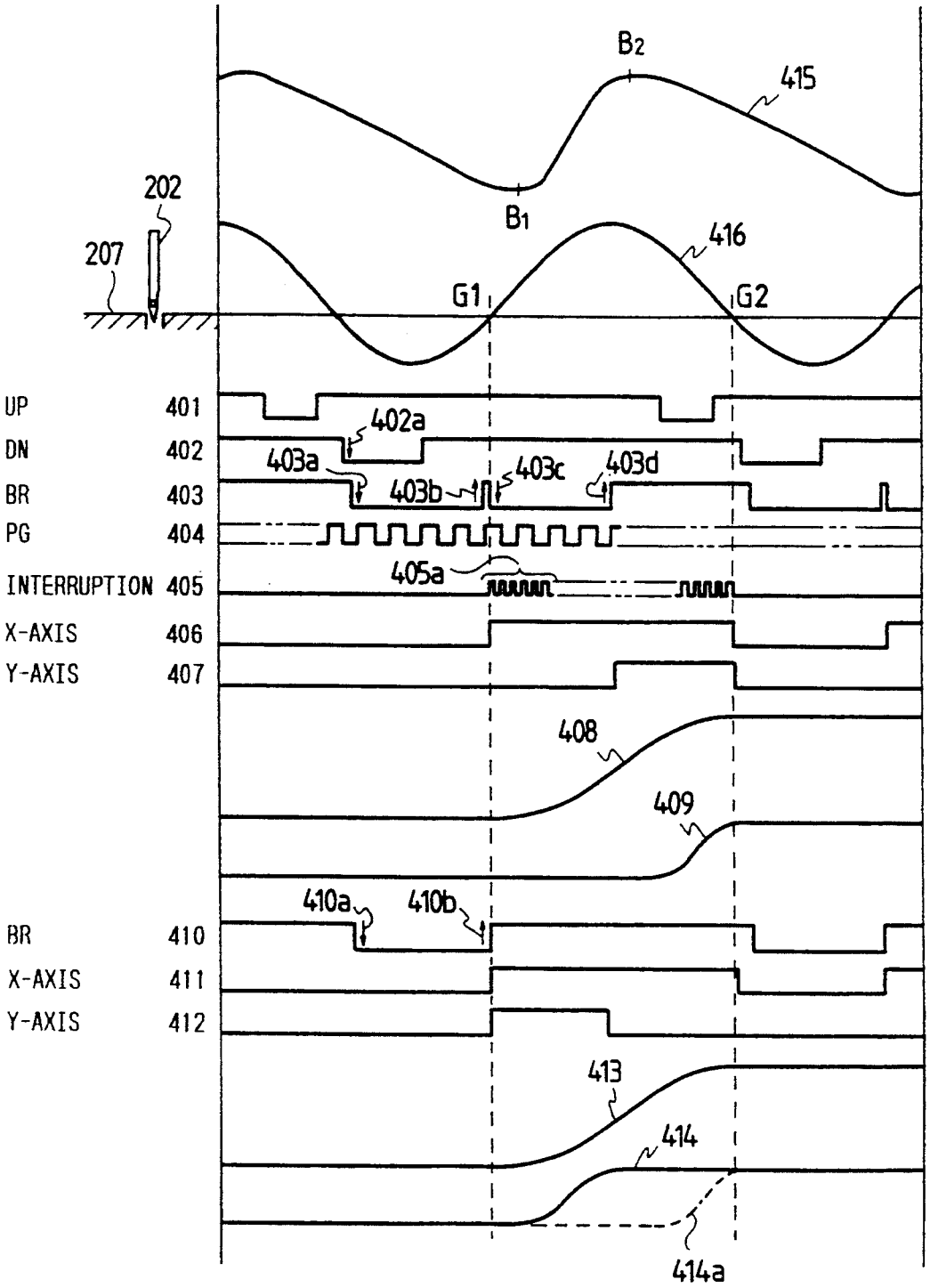
FIG. 26 is a time chart showing the timing of operation of a bi-axial drive unit in the control device according to the invention.

The control operation of the bi-axial drive mechanism 208 of a conventional automatic sewing machine used with the present invention will be described with reference to FIGS. 20 through 22, flow charts, and FIG. 26, a time chart (including signals 401 through 409) in detail. In FIG. 26, reference numeral 403 designates a borrow signal (hereinafter referred to as "a BR signal", when applicable); 406 and 407, signals representing that the X-axis and Y-axis stepping motors 27 and 28 are driven (hereinafter referred to as "stepping motor drive signals", when applicable), respectively; and 408 and 409 waveforms indicating the loci of X-direction and Y-direction movement of the presser unit 206 on the shuttle race slide 207, respectively. In this embodiment of the invention, for simplification in description, only the case where the bi-axial drive mechanism 208 is driven on both the X-axis and the Y-axis;

that is, the presser unit 206 is moved obliquely on the shuttle race slide 207 will be described (the driving of it only on one axis being the same as in the prior art).

Figure 3:
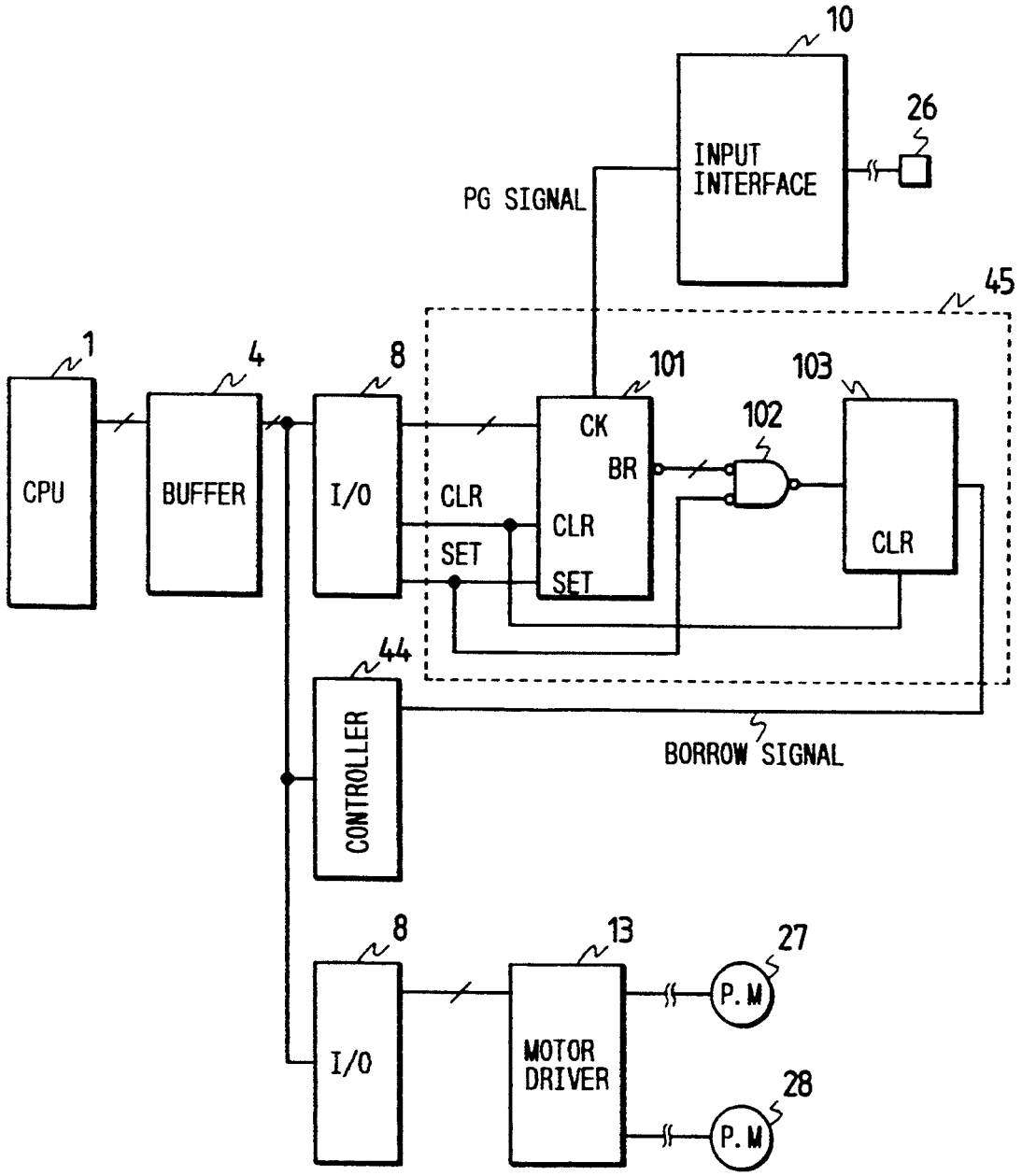
FIG. 3 is a block diagram showing a feed pulse delay circuit shown in FIG. 2.
Figures 4, 5:
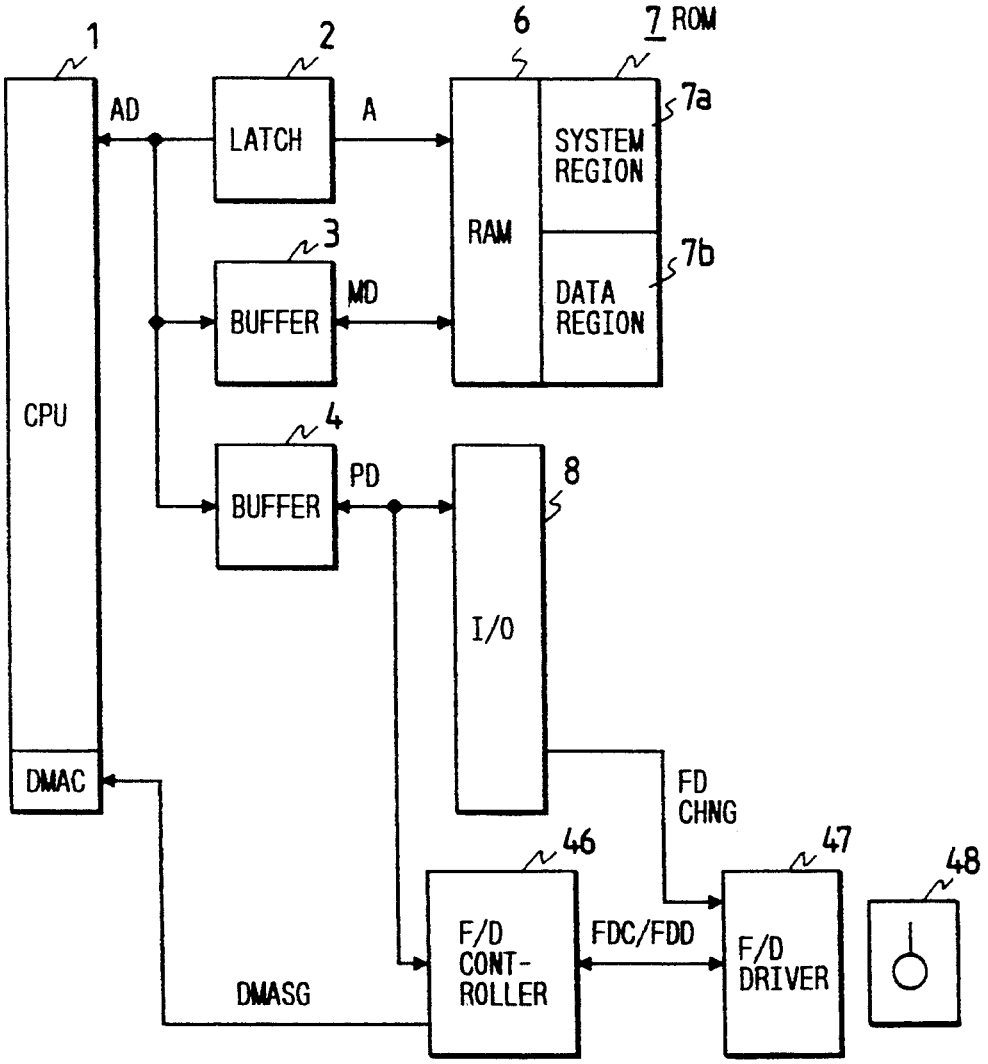
FIG. 4 is a block diagram showing data reading and writing means in FIG. 2.
FIG. 5 is an explanatory diagram showing the arrangement of data in a data region in conventional memory means.
Figure 9:
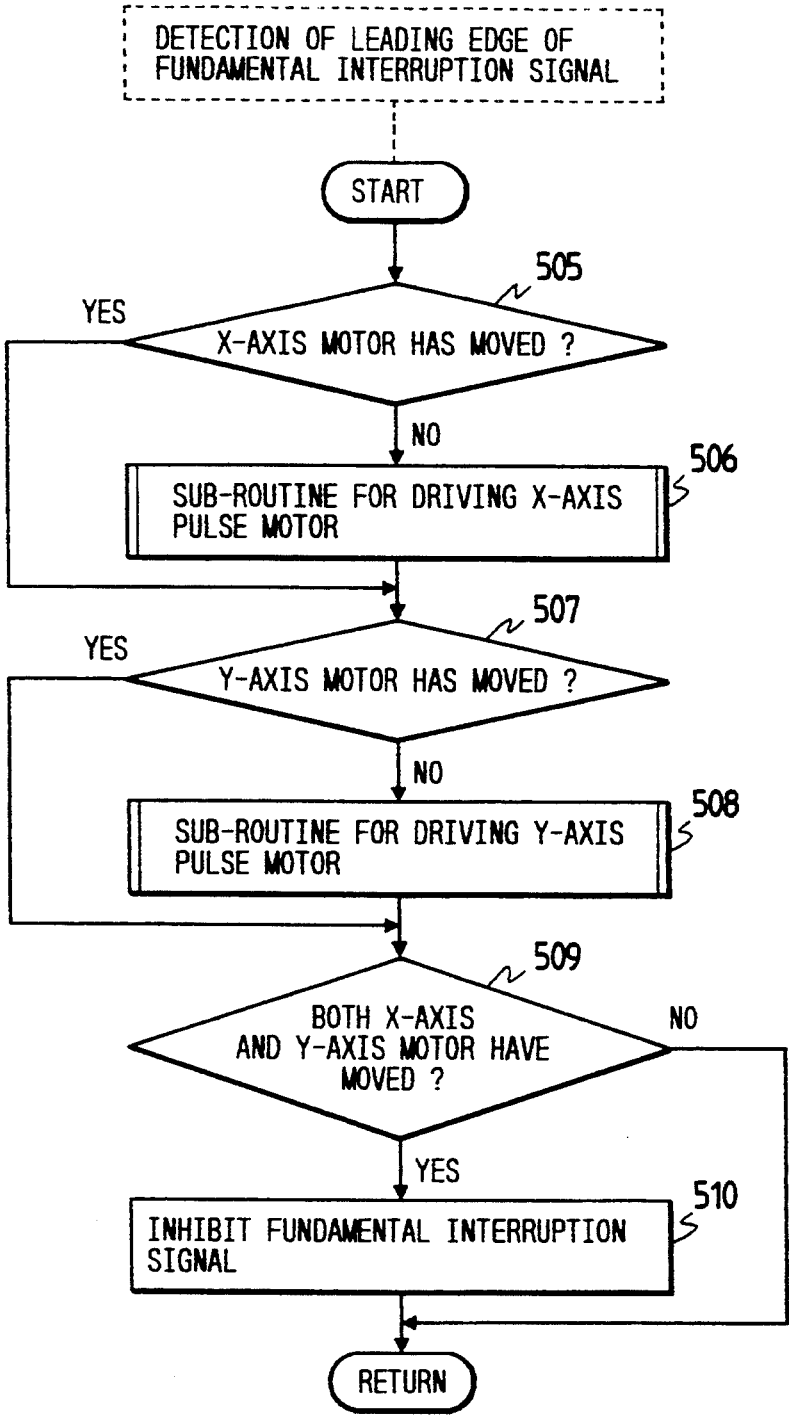
FIG. 9 is a flow chart for a description of a conventional X Y table movement process.
Figure 10:
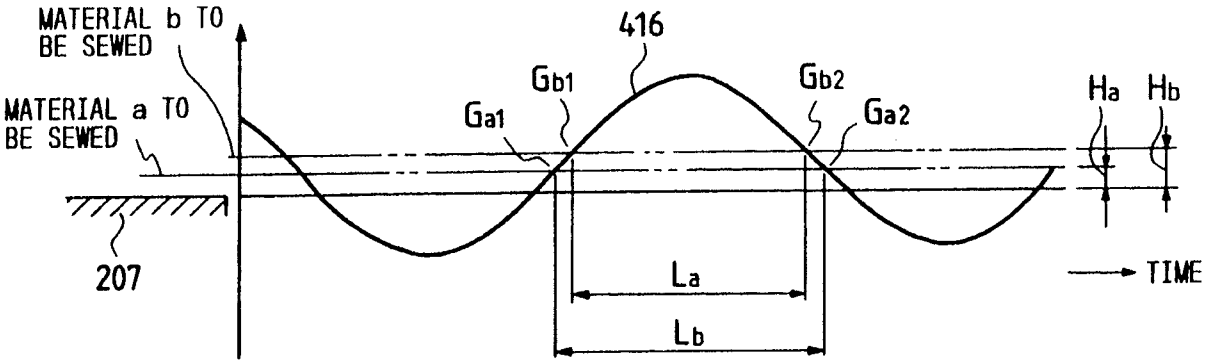
FIG. 10 is an explanatory diagram for a description of the thickness of sewing material to be sewed and the timing of starting the bi-axial drive mechanism.
Figure 11:
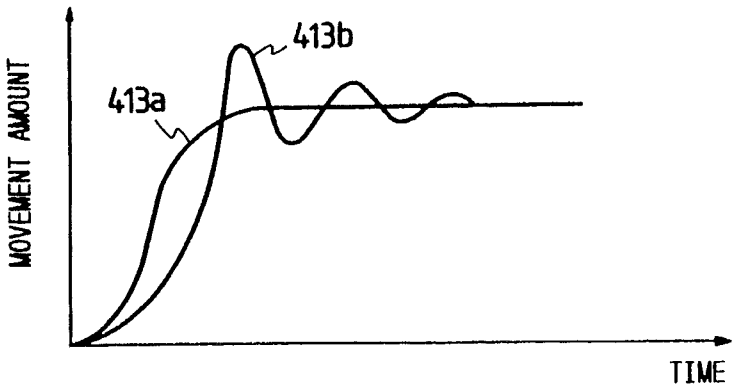
FIG. 11 is a graphical representation indicating the loci of the presser unit with loads applied to the bi-axial drive mechanism.
Figure 20:
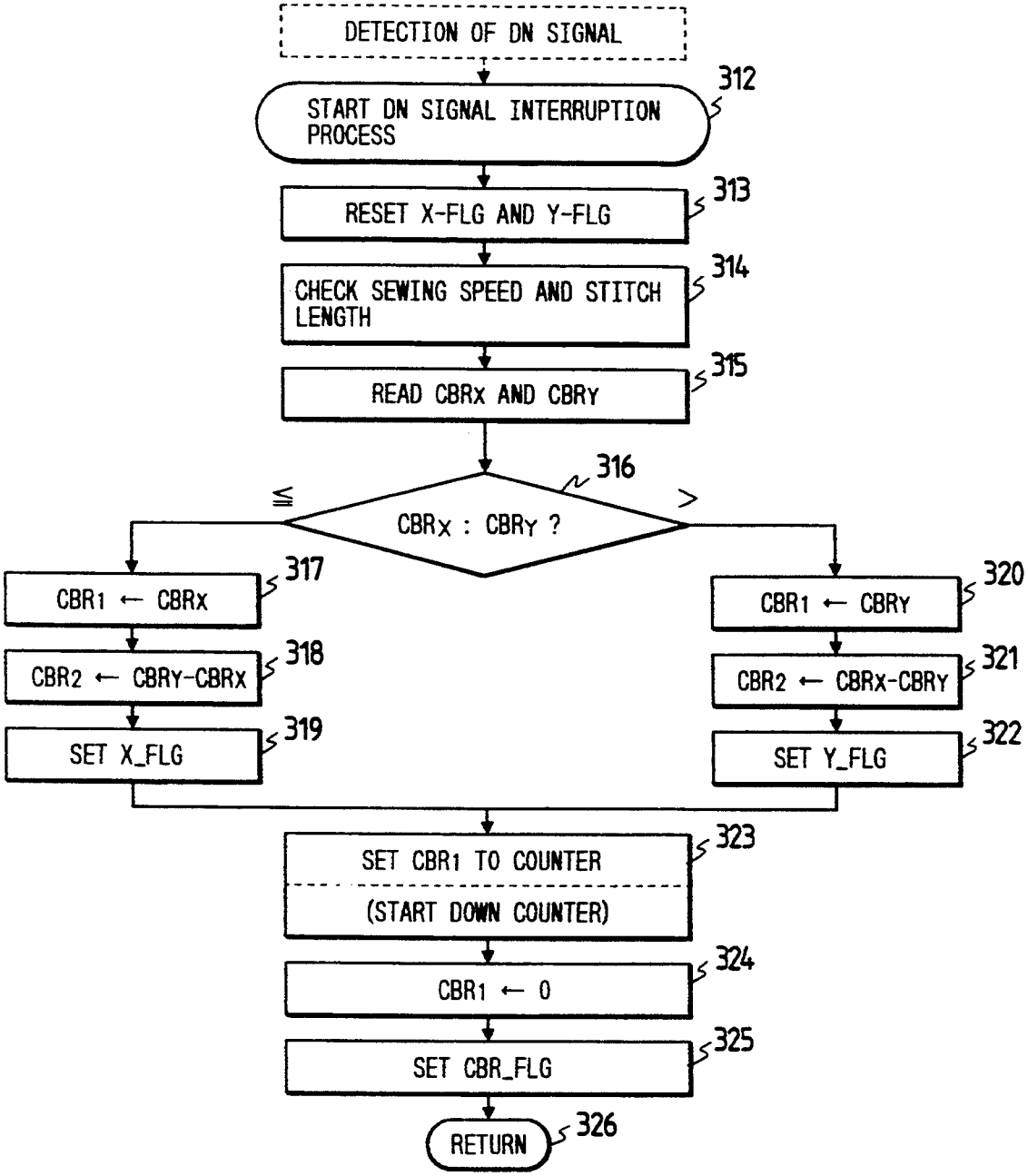
FIG. 20 is a flow chart for a description of a DN signal interruption process in the control device of the invention.

When the detector 26 outputs the DN signal with the sewing machine mechanism section 25 driven, a DN signal interruption process, as shown in FIG. 20, is started (Step 312), and then in Step 313 X-axis and Y-axis movement permission flags X FLG and Y FLG are reset; that is, the movement is inhibited. In the following Step 314, the speed of rotation of the sewing machine and stitch length for the next one stitch are written on to a stack in the microcomputer 1. In Step 315, access is made to the RAM 6, so that X-axis and Y-axis delay pulse numbers CBRX and CBRY corresponding to the aforementioned speed of rotation and stitch length are written on to the stack in the microcomputer 1. In Step 316, the X-axis and Y-axis delay pulse numbers CBRX and CBRY are subjected to comparison. When it is determined that the X-axis delay pulse number CBRX is equal to or smaller than the Y-axis delay pulse number CBRY, Step 3117 is effected. That is, in Step 317, the X-axis delay pulse number CBRX is substituted for a first start inhibition pulse number CBR1 (hereinafter referred to as "a first delay pulse number CBR1", when applicable). And in Step 318, the value obtained by subtracting the X-axis delay pulse number CBRX from the Y-axis delay pulse number CBRY is substituted for a second start inhibition pulse number CBR2 (hereinafter referred to as "a second delay pulse number CBR2", when applicable). Thereafter, in Step 319, the X-axis movement permission flag X FLG is set, so that only the X-axis movement is permitted. Under this condition, Step 323 is effected. On the other hand, when it is determined in Step 316 that the X-axis delay pulse number CBRX is larger than the Y-axis delay pulse number CBRY, Step 320 is effected. In Step 320, the Y-axis delay pulse number CBRY is substituted for the first delay pulse number CBR1. Thereafter, in Step 321, the value obtained by subtracting the Y-axis delay pulse number CBRY from the X-axis delay pulse number CBRY is substituted for the second delay pulse number CBR2. In Step 322, the Y-axis movement permission flag Y-FLG is set, so that only the Y-axis movement is permitted. Under this condition, Step 323 is effected. In Step 323, the first delay pulse number CBR 1 is applied through the data buffer 4 and the I/O 8 to the down counter 101, where it is set (FIG. 3). Immediately after this, in Step 324 the first delay pulse number CBR1 is cleared. Then, in Step 325, a count borrow process interruption permission flag CBR FLG is set. Thus, in Step 326, the DN signal interruption process routine is ended.

Immediately when the delay pulse number is set in the down counter 101, the BR signal output by the flip-flop circuit 103 is set to zero level. This state is indicated at 403a in FIG. 26. Whenever the detector 26 applies the PG signal through the input interface circuit 10 to the down counter 101, the contents of the down counter 101 is decreased. When the contents of the down counter 101 is decreased to zero in this manner, the down counter 101 applies a pulse signal through the OR circuit 102 to the flip-flop circuit 103, as a result of which the output BR signal of the flip-flop circuit 103 is raised to high level. This state is indicated at 403*b* in FIG. 26.

When the BR signal is raised to high level as was described above, an interruption controller 44 interrupts the microcomputer 1. In response to this interruption, the microcomputer 1 starts a count borrow interruption process as shown in FIG. 21 (Step 327). As shown in FIG. 21, in Step 328 it is determined whether or not the count borrow process interruption permission flag CBR-FLG has been set. In the flow of the DN signal interruption process shown in FIG. 20, the flag CBR-FLG has been set, and therefore Step 329 is effected. In Step 329, it is determined whether or not the second delay pulse number CBR2 is zero. If not zero, Step 330 is effected. In Step 330, the second delay pulse number CBR2 is set in the down counter 101. Thereafter, in Step 331, the second delay pulse number CBR2 is cleared; and in Step 336, the outputting of a stepping motor driving fundamental interruption signal 405 is permitted. Thus, the count borrow interruption process is ended. This state is indicated at 405*a* in FIG. 26. On the other hand, in Step 330 the second delay pulse number CBR2 is set again, and therefore similarly as in the preceding procedure the BR signal is output (as indicated at 403*c*) and reset with count 0 (as indicated at 403*d*). As a result, the count borrow interruption process is started. In this case, since in Step 331 the second delay pulse number CBR2 has been cleared, Steps 328 and 329 are effected, and then Step 332 is effected. In Step 332, the count borrow interruption process flag is reset. Next, in Step 333, it is determined whether or not the X-axis movement permission flag X FLG has been set. That is, the first delay pulse is for starting the X-axis movement, and it has been determined whether or not the X-axis movement has been started. When it has been determined that the flag X FLG has been set, then the X-axis movement has been started. Hence, Step 335 is effected. In Step 335, the Y-axis movement permission flag Y-FLG is set. When it is determined that the flag X FLG has not been set, the Y-axis movement has been started. Therefore, Step 334 is effected. In Step 334, the X-axis movement permission flag X-FIG is set. Thereafter, the above-described 336 is effected, and the count borrow interruption process is ended.

The stepping motor driving fundamental interruption signal 405 output with permission is continuously produced until the outputting is inhibited. Whenever the rise edge 405*a* of the fundamental interruption signal 405 is detected, the micro-computer 1 starts an X Y table movement process as shown in FIG. 22 (Step 338). In this routine, in Step 339 it is determined whether or not the X-axis movement permission flag X-FLG has been set; that is, whether or not the X-axis movement has been permitted. When it is determined that the flag X-FLG has not been set, Step 342 is effected; and when it is determined that the flag has been set, Step 340 is effected. In Step 340, it is determined whether or not the X-axis movement has been accomplished; that is, whether or not the movement of one stitch length has been made. When it is determined that the movement has been done, Step 342 is effected; and when it is determined that the movement has not been done yet, Step 341, an X table movement processing subroutine, is effected. That is, in Step 341, the X-axis drive mechanism is moved. In Step 342, it is determined whether or not the Y-axis movement permission flag Y FLG has been set. If not set, Step 345 is effected; and if set, Step 343 is effected. In Step 343, it is determined whether or not the Y-axis movement has been accomplished. When it is determined that the Y-axis movement has been accomplished, Step 345 is effected. When it is determined that the Y-axis movement has not been accomplished, Step 345, a Y table movement processing subroutine, is effected. That is, in Step 345, a Y-axis drive mechanism is moved. In Step 345, it is determined whether or not the X-axis movement and the Y-axis movement have been accomplished. When it is determined that either the X-axis movement or the Y-axis movement has not been accomplished, Step 347 is effected. When it is determined that both the X-axis and the Y-axis movement have been accomplished, Step 346 is effected. In Step 346, the outputting of the stepping motor driving fundamental interruption signal 405 is inhibited. Thus, in Step 347, the X Y table movement process is ended. The X Y table movement process is repeatedly carried out until the X axis and the Y axis move as much as one stitch length preset; that is, it is repeatedly performed as long as the drive signals 406 and 407 are output. Upon completion of the movement, the output of the fundamental interruption signal 405 is inhibited, and this routine is not executed until the output of the fundamental interruption signal 405 is permitted.

Figure 27:
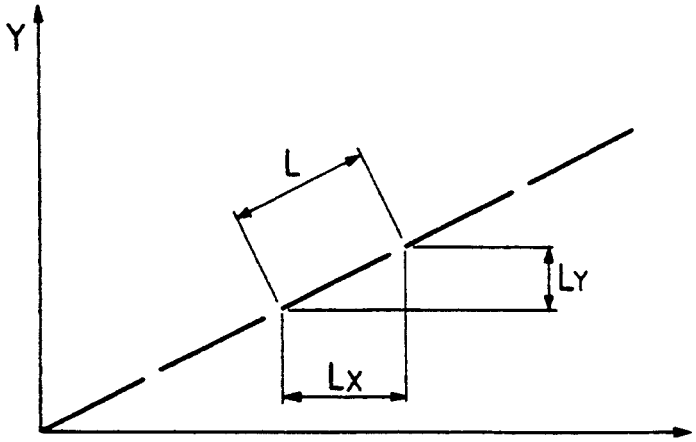
FIG. 27 is an explanatory diagram showing a stitch pattern for a description of the following FIG. 28.
Figure 28:
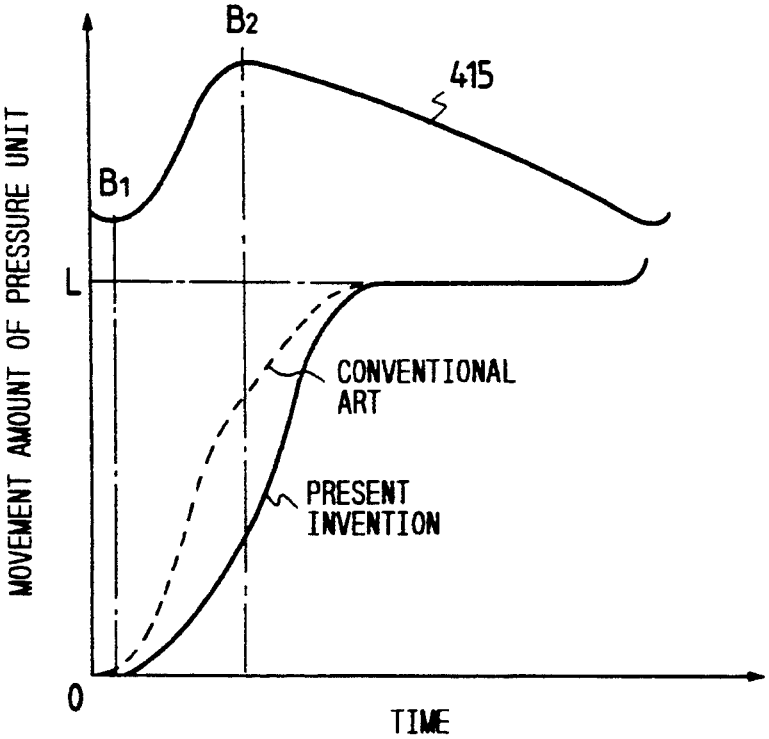
FIG. 28 is a graphical representation indicating the amounts of movement of a presser unit with the motion of a thread take-up lever.

In the case where, with the automatic sewing machine control device thus constructed, a sewing operation is performed to form a stitch pattern as shown in FIG. 27, the loci of movement, in the directions of X-axis and Y-axis, of the presser unit 206 are as indicated at 408 and 409 in FIG. 26, respectively. The composite locus of the loci of movement in the directions of X-axis and Y-axis, of the presser unit is indicated by the solid line in FIG. 28, and the corresponding composite locus in the prior art is indicated by the broken line. The amount of movement of the presser unit 206 provided while the thread take-up lever 203 moves from the bottom dead point B1 to the top dead point B2 is smaller than in the prior art. This is because the count borrow process according to the invention allows the X-axis movement and the Y-axis movement to start with individual timing, whereby the timing of starting the axis movement (which is the Y-axis movement in the embodiment) shorter in movement time can be delayed with respect to the time instant that the thread take-up lever 203 is pulled up, in the range (between G1 and G2 in FIG. 26) that the movement of the sewing material does not interfere with the needle bar.

According to the second factor limiting the timing of starting the presser unit 206 which has been described with reference to the operation of the prior art, it is possible to correct the thread tightening of a sewing material. In this connection, experiments have been conducted with the automatic sewing machine control device according to the invention. It has been confirmed through the experiments that the sewing material is corrected when compared with the one prepared according to the prior art.

Now, the operation of the automatic sewing machine control device will be described with reference to FIG. 16. In the flow chart shown in FIG. 16, the operations of Steps 300 through 303 are equal to those which have been described before. When, in Step 304, the change-over switches **15*b* and 15*c* are both turned on, Step 348 is effected. In Step 348, an automatic cloth thickness setting mode is selected. Thereafter, in Step 349, the address of the sewing data is specified. Then, in step 350, the sewing data is read from the data ROM 7*b* in the ROM 7. In this data reading operation, only the pulse data 220 is read. With such a control device, the count borrow data 221 and the speed limit data 222** are not read.

Figure 23:
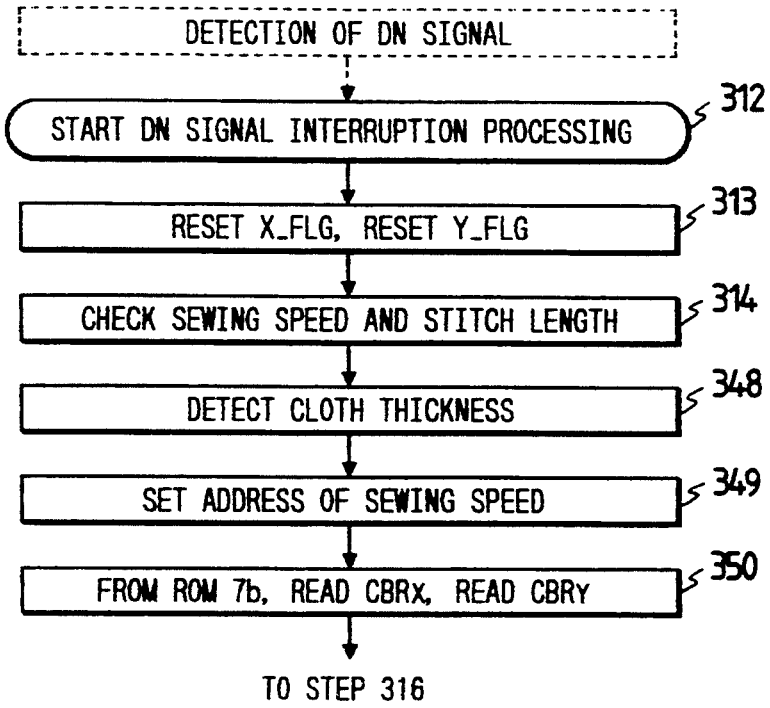
FIG. 23 is a flow chart for a description of a DN signal interruption process in the control device according to claim 6.

FIG. 23 is a flow chart for a description of the DN signal interruption process in the control device. In FIG. 23, the Steps which have been described with reference to the control device are therefore designated by the same reference numerals. In the control device, the count borrow process and the X Y table movement process are the same as those in the above described control device. As shown in FIG. 23, in Steps 312 through 314, the DN signal is detected, the DN signal interruption process is started, the X-axis movement permission flag X FLG and the Y-axis movement permission flag Y FLG are reset, and the speed of rotation of the sewing machine and stitch length for the next one stitch are written on to the stack in the microcomputer 1. Thereupon, in Step 348, the microcomputer 1 receives the cloth thickness data from the displacement sensor 55 (FIG. 15) through the operational amplifier 58, the sample and hold circuit 59 and the A/D converter 60, and writes it on to the stack. Thereafter, in Step 349, in the count borrow table 221 and the speed limit table 222 in the data ROM **7*b* shown in FIG. 17**, the addresses are specified where the delay pulse number and the speed limit are stored which correspond to the above-described speed of rotation, stitch length, and cloth thickness data.

Thereafter, in Step 350, the addresses are referred to, so that the sewing data operated and stored in advance, namely, the count borrow data 221 and the speed limit data 222 are stored in the data region in the RAM 6.

FIG. 19 is a table indicating the cloth thickness values provided by the displacement sensor 55 with the addresses of the count borrow data 221 and the speed limit data 222 in the above mentioned control device. In the case of FIG. 19, sewing materials ranged from 0 mm to 3 mm in thickness are handled as those small in thickness, sewing materials ranged from 3.1 mm to 6.0 mm in thickness are handled as those intermediate in thickness, and sewing materials 6.1 mm or higher are handled as those large in thickness. That is, the count borrow data 221 and the speed limit data 222 corresponding to those three different ranges of cloth thickness are selected. For instance, if, when the change-over switch **15*a* is turned off; that is, when load weight of the bi-axial drive mechanism 208 is heavy, the cloth thickness value provided by the displacement sensor 55 is 4 mm, then the microcomputer 1** reads the count borrow data from the address (g) and the speed limit data from the address (m).

Figure 24:
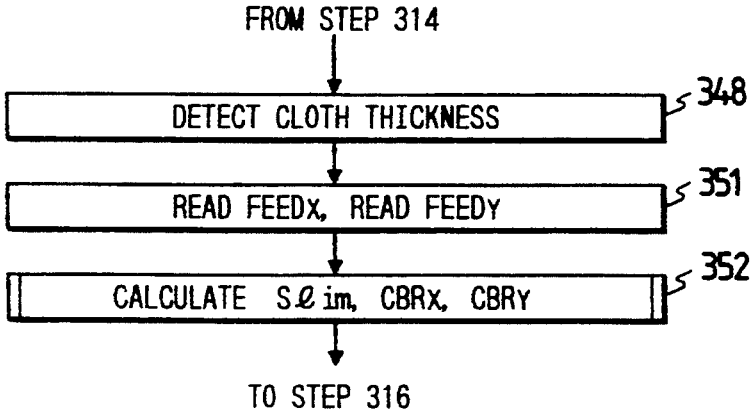
FIG. 24 is a flow chart for a description of a DN signal interruption process in the control device according to the invention.

FIG. 24 shows a flow chart for the DN signal interruption process in the control device. In the control device, the flow of operation between the turning on of the power switch and the starting of the sewing operation, the count borrow process and the X Y table movement process are the same as those in the above control device. As shown in FIG. 24, in Step 348, the microcomputer 1 receives the cloth thickness data from the displacement sensor 55 (FIG. 15), and then in Step 351 the microcomputer 1 reads from the feed time data table 223 in the ROM **7*b* the movement time periods FEEDX and FEEDY corresponding to the X-axis and Y-axis stitch length data stored in the stack in it. The term "feed time" as used herein is intended to mean the period of time during which the stepping motor driver 13 applies the pulses to the stepping motors 27 and 28**, being made up of 127 data from 0.1 mm up to 12.7 mm at intervals of 0.1 mm for each axis depending on the stitch lengths (i.e., 254 data in total for the X-axis and the Y-axis). The X-axis feed time is represented by FEEDX, and the Y-axis feed time, by FEEDY.

Figure 25:
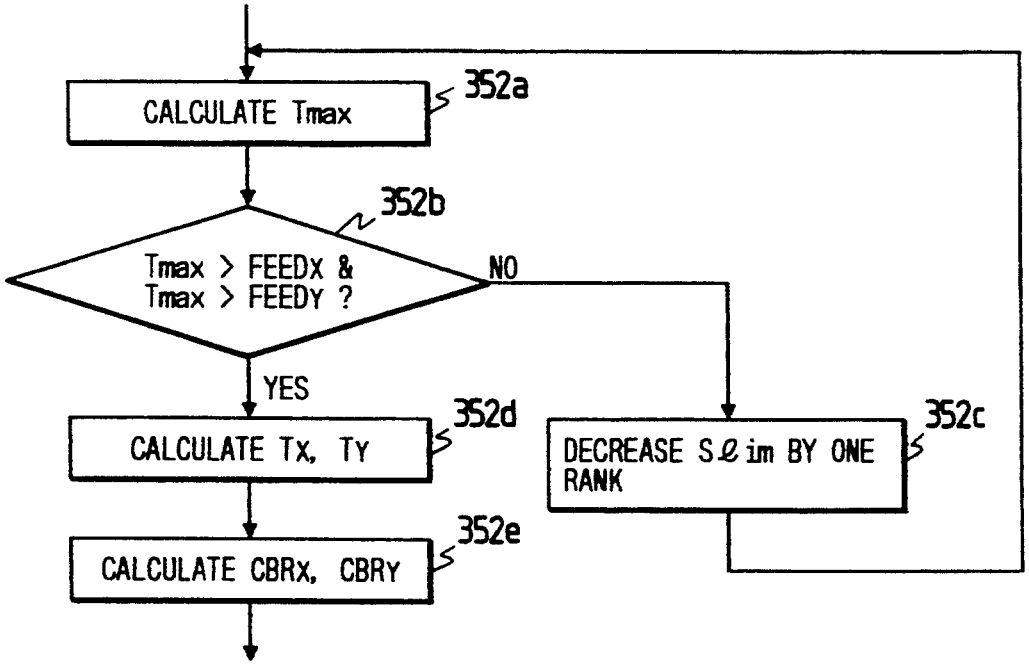
FIG. 25 is a flow chart for a description of a delay pulse arithmetic process shown in FIG. 24.

After the feed time is read in Step 351 in FIG. 24, in the following Step 352 delay pulse numbers CBRX and CBRY and a speed limit SLIM are calculated by using the feed time FEEDX and FEEDY, the speed of rotation of the sewing machine and the cloth thickness data as parameters. This will be described with reference to a flow chart of FIG. 25, and to a time chart of FIG. 29.

Figure 29:
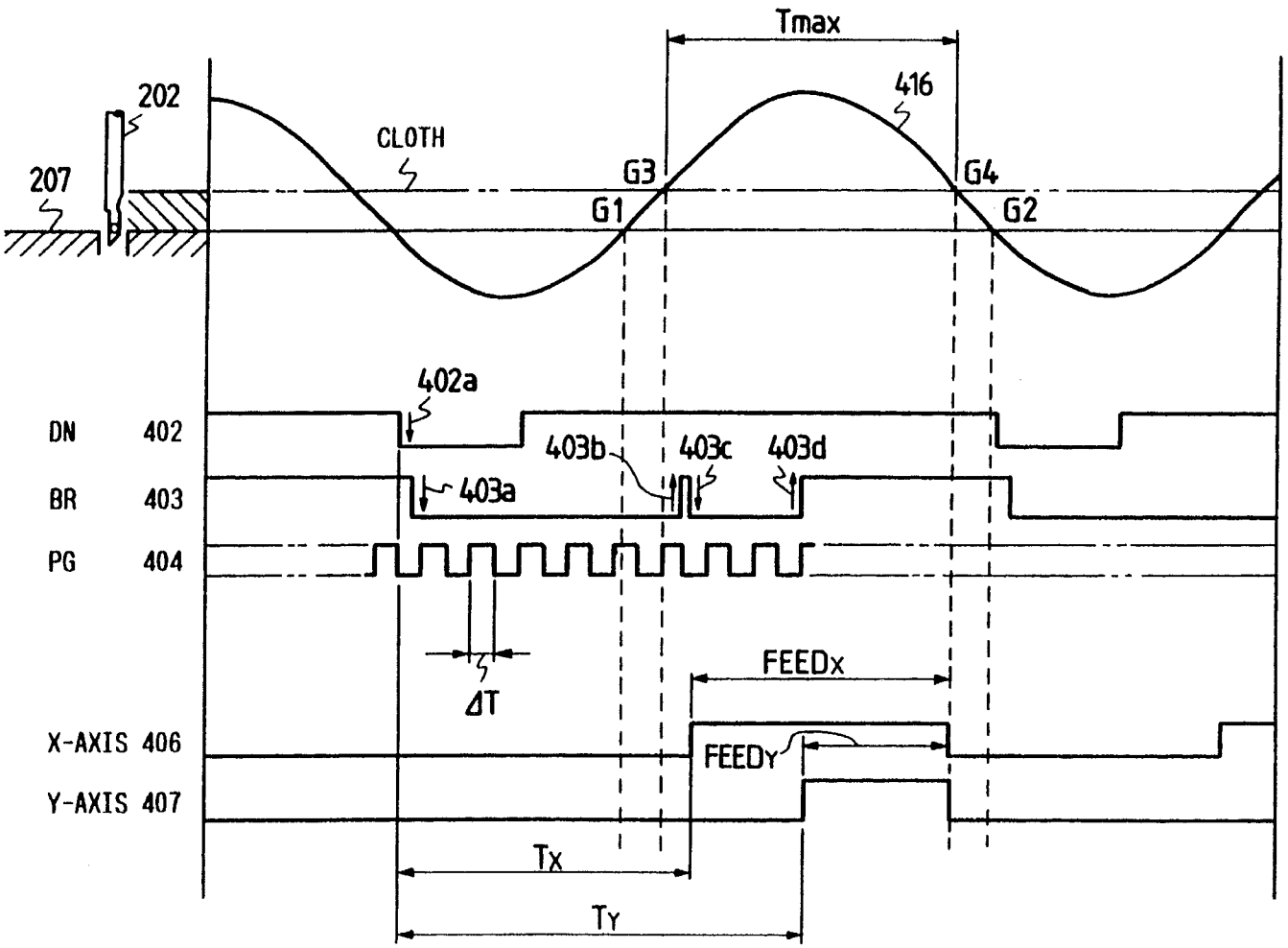
FIG. 29 is a diagram for a description of the technical concept of a delay pulse arithmetic process in an automatic sewing machine control device according to claim 2 or 3.

In FIG. 29, reference character AT designates the pulse period of the PG signal; G3 and G4, the intersections of the needle bar 202 and the sewing material with the cloth thickness taken into account; G3, the point where the needle is pulled out of the sewing material; G4, the point where the needle is pushed into the sewing material; and TMAX, the period of time (between G3 and G4) for which the needle is not pushed into the sewing material (i.e., the presser unit is movable). First, in Step 352*a*, the period of time TMAX is calculated from the speed of rotation of the sewing machine. Next, in Step 352*b*, the period of time TMAX is compared with the X-axis and Y-axis pulse application time periods FEEDX and FEEDY. If FEEDX or FEEDY is larger than TMAX, then the needle bar 202 will interfere with the sewing material, and therefore Step 352*c* is effected. In Step 352*c*, the speed limit SLIM is decreased by one rank, and then Step 352*a* is effected again. The speed of rotation of the sewing machine is decreased until the condition in Step 352*b* is satisfied, so that the speed limit SLIM is determined. Thereafter, in Step 352*d*, the period of time which elapses from the fall edge 402*a* of the DN signal until the time instant G4 that the needle is pushed into the sewing material, and the X-axis and Y-axis feed time FEEDX and FEEDY are utilized to calculate the periods of time TX and TY which elapse from the fall edge 402*a* (sic) of the DN signal until the presser unit 206 (sic) starts. Thereafter, in Step 352*e*, the X-axis and Y-axis delay pulse numbers CBRX and CBRY are calculated from the following Equations (1) and (2) by using the starting period of times TX and TY, and the pulse period ΔT of the PG signal 404:

$$CBRX = TX/\Delta T \quad (1)$$

$$CBRY = TY/\Delta T \quad (2)$$

In the control device according to claim 2 or 3, it goes without saying that, in the case where materials to be sewed are constant in thickness, it is unnecessary to calculate the speed limit because it is known in advance.

In the above-described control device according to each of claims 1 through 6, the reading of sewing data for each stitch and the setting of delay pulse numbers are effected with the fall edge of the lower position signal of the needle bar 202 triggered; however, it goes without saying that any other signal which is synchronous with the rotation of the sewing machine can be utilized for the same effects. Furthermore, the borrow signal generating mechanism is of hardware (hereinafter referred to merely as "H/W", when applicable); however, software (hereinafter referred to as "S/W", when applicable) means may be employed as follows: The microcomputer 1 is caused to recognize the PG signal with an interruption signal or the like, and the number of PG signals is counted by the S/W means, thereby to determine the timing of starting the bi-axial drive mechanism 208.

In the above-described embodiment, the output of the change-over switch 15 is read when the power switch is turned on; however, it may be read at any time before the sewing operation is started. In the above-described embodiment, the switching means is of hardware; however, it may be replaced by a switch of software which is controlled through the operating panel.

Furthermore, in the control device of the invention, when the power switch is turned on, the data tables in the ROM 7 are transferred into the RAM 6. This is merely to facilitate the debugging process. Hence, in a sewing operation, the microcomputer 1 may read the data tables directly from the ROM 7. In addition, in the control device described above, the sewing data are stored in the ROM 7; however, the invention is not limited thereto or thereby. That is, the sewing data may be stored in a memory medium such as a floppy disk 48, or they may be transmitted from a personal computer through communication.

In the control device according to claim 6, the cloth thickness detecting means is made up of the slider and the displacement sensor as shown in FIG. 14; however, the invention is not limited thereto or thereby. That is, the same effect can be obtained by using any other means which can detect the cloth thickness near the needle bar with real time.

As was described above, in the automatic sewing machine control device according to the present invention, the following effects can be obtained.

(1) Since the X-axis and the Y-axis are controlled with the respective start timing modes, this improves the thread tightening of the sewing material, and gives excellent sewing conditions.

(2) The arithmetic means forms the start timing data for the bi-axial drive mechanism, and therefore the control device has an effect that the start timing data region can be utilized economically in addition to the effects of the control device as discussed in the above (1).

(3) Since the arithmetic means for the start timing data for the bi-axial drive mechanism, and the maximum speed of rotation of the sewing machine, the control device has an effect that the presser unit will not contact the needle bar; that is, the feed control is stable at all times, in addition to the effects of the control device as discussed in the above (2).

(4) Since a plurality of drive control data are provided separately according to weight loads applied to the drive system, the data selecting means selects one of the drive control data according to a weight load applied to the drive system, thus ensuring the stable operation of the bi-axial drive mechanism.

(5) A plurality of drive control data are provided for the bi-axial drive mechanism according to the thicknesses of sewing materials to be sewed. The data selecting means selects one of the drive control data suitably, so that the feed control is made stable irrespective of the thickness of the sewing material.

(6) The suitable drive control data is automatically selected according to the output signal of the cloth thickness detecting means. Hence, the feed control is stable even if the sewing material changes in thickness during sewing.

What is claimed is:

1. A control device for an automatic sewing machine comprising:

a drive motor for driving a spindle of said automatic sewing machine;

a presser unit for pressing a sewing material to be sewed against a flat surface extending beneath said presser unit and a needle of said automatic sewing machine, said presser unit holding said sewing material stationary on said flat surface during a sewing operation and feeding said sewing material along said flat surface, according to a predetermined pattern, during a time when said needle is raised away from said sewing material;

a bi-axial drive mechanism for driving said presser unit in the directions of two axes separately, said two axes being perpendicular to each other;

a drive control means for controlling said drive motor and said bi-axial drive mechanism according to programs and data stored in a memory means; and a start timing control means for controlling a first start time of said bi-axial drive mechanism for initiating movement of said presser unit in a first direction and a second start time of said bi-axial drive mechanism for initiating movement of said presser unit in a second direction, wherein said first start time and said second start time, for moving said presser unit in a direction corresponding to a stitch which includes components from said two axes so that no portion of said stitch is parallel to either one of said two axes for an entire length of said stitch, are different when an amount of movement of said presser unit in said first direction is different from an amount of movement of said presser unit in said second direction, and for controlling said bi-axial drive mechanism to simultaneously terminate movement of said presser unit in said first direction and said second direction when said needle is lowered toward said sewing material;

wherein said first start time and said second start time are adjusted in accordance with movement of said needle to provide for termination of movement of said bi-axial drive mechanism in said first direction and said second direction at a point when said needle penetrates said sewing material.

2. The control device as defined in claim 1, further comprising arithmetic means for using drive control data provided for said bi-axial drive mechanism to generate start timing data for said bi-axial drive mechanism, said start timing control means controlling said bi-axial drive mechanism with respective timing modes according to the start timing data generated by said arithmetic means.

3. The control device as defined in claim 1, further comprising arithmetic means for using data indicating a period of time during which said presser unit is movable and drive control data provided for said bi-axial drive mechanism to generate start timing data for said bi-axial drive mechanism and maximum rotation speed data for said automatic sewing machine;

said start timing control means controlling said bi-axial drive mechanism with respective timing modes according to the start timing data generated by said arithmetic means, said drive motor being controlled according to the maximum speed data.

4. A control device for an automatic sewing machine comprising:

a drive motor for driving a spindle of said automatic sewing machine a presser unit for pressing a sewing material to be sewed against a flat surface extending beneath said presser unit and a needle of said automatic sewing machine, said presser unit holding said sewing material stationary on said flat surface during a sewing operation and feeding said sewing material along said flat surface, according to a predetermined pattern, during a time when said needle is raised away from said sewing material;

a bi-axial drive mechanism for driving said presser unit in the directions of two axes separately, said two axes being perpendicular to each other;

a drive control means for controlling said drive motor and said bi-axial drive mechanism according to programs and data stored in a memory means;

a start timing control means for controlling a first start time of said bi-axial drive mechanism for initiating movement of said presser unit in a first direction and a second start time of said bi-axial drive mechanism for initiating movement of said presser unit in a second direction, wherein said first start time and said second start time are different from each other when an amount of movement of said presser unit in said first direction is different from an amount of movement of said presser unit in said second direction; and data selecting means for storing in said memory means a plurality of drive control data provided separately according to load weights applied to a drive system provided for said bi-axial drive mechanism and said presser unit, said data selecting means selectively reading the drive control data from said memory means according to a specific load weight applied to said drive system.

5. A control device for an automatic sewing machine comprising:

a drive motor for driving a spindle of said automatic sewing machine;

a presser unit for pressing a sewing material to be sewed against a flat surface extending beneath said presser unit and a needle of said automatic sewing machine, said presser unit holding said sewing material stationary on said flat surface during a sewing operation and feeding said sewing material along said flat surface, according to a predetermined pattern, during a time when said needle is raised away from said sewing material;

a bi-axial drive mechanic for driving said presser unit in the directions of two axes separately, said two axes being perpendicular to each other;

a drive control means to controlling said drive motor and said bi-axial drive mechanism according to programs and data stored in a memory means; and a start timing control means for controlling a first start time of said bi-axial drive mechanism for initiating movement of said presser unit in a first direction and a second start time of said bi-axial drive mechanism for initiating movement of said presser unit in a second direction, wherein said first start time and said second start time are different from each other when a amount of movement of said presser unit in said first direction is different from an amount of movement of said presser unit in said second direction;

said control device further comprising data selecting means for storing in said memory means a plurality of drive control data provided separately according to thicknesses of sewing materials to be sewed, said data selecting means selectively reading the drive control data from said memory means according to a thickness of one of said sewing materials selected to be sewed.

6. A control device for an automatic sewing machine comprising:

a drive motor for driving a spindle of said automatic sewing machine;

a presser unit for pressing a sewing material to be sewed against a flat surface extending beneath said presser unit and a needle of said automatic sewing machine, said presser unit holding said sewing material stationary on said flat surface during a sewing operation and feeding said sewing material along said flat surface, according to a predetermined pattern, during a time when said needle is raised away from said sewing material;

a bi-axial drive mechanism for driving said presser unit in the directions of two axes separately, said two axes being perpendicular to each other;

a drive control means for controlling said drive motor and said bi-axial drive mechanism according to programs and data stored in a memory means; and a start timing control means for controlling a first start time of said bi-axial drive mechanism for initiating movement of said presser unit in a first direction and a second start time of said bi-axial drive mechanism for initiating movement of said presser unit in a second direction, wherein said first start time and said second start time are different from each other when an amount of movement of said presser unit in said first direction is different from an amount of movement of said presser unit in said second direction;

said control device further comprising cloth thickness detecting means for storing in said memory means a plurality of drive control data provided separately according to thicknesses of sewing materials to be sewed, said cloth thickness detecting means detecting a thickness of each of said sewing materials to be sewed; and automatic data selecting means for automatically selectively reading, according to a signal provided by said cloth thickness detecting means, the drive control data from said memory means according to the thickness of one of said sewing materials selected to be sewed.

* * * * *